US008741524B2

(12) United States Patent
Sugiura

(10) Patent No.: US 8,741,524 B2
(45) Date of Patent: Jun. 3, 2014

(54) TONER, DEVELOPER, AND IMAGE FORMING METHOD

(75) Inventor: Hideki Sugiura, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 500 days.

(21) Appl. No.: 12/388,152

(22) Filed: Feb. 18, 2009

(65) Prior Publication Data

US 2009/0220883 A1 Sep. 3, 2009

(30) Foreign Application Priority Data

Feb. 28, 2008 (JP) ..... 2008-048606
Jul. 17, 2008 (JP) ..... 2008-185730

(51) Int. Cl.
*G03G 9/00* (2006.01)

(52) U.S. Cl.
USPC ..... 430/110.2; 430/118.8; 430/123.55; 430/124.1; 430/137.17

(58) Field of Classification Search
USPC ..... 430/110.2, 118.8, 137.17, 123.55, 430/124.1
See application file for complete search history.

(56) References Cited

U.S. PATENT DOCUMENTS

| | | | | |
|---|---|---|---|---|
| 4,954,412 | A * | 9/1990 | Breton et al. | 430/137.12 |
| 5,066,397 | A * | 11/1991 | Muto et al. | 210/321.61 |
| 5,948,582 | A * | 9/1999 | Nakamura et al. | 430/110.3 |
| 6,630,276 | B2 | 10/2003 | Sugiura et al. | |
| 6,780,556 | B2 | 8/2004 | Sugiura et al. | |
| 6,818,369 | B2 | 11/2004 | Sugiura et al. | |
| 7,163,773 | B2 | 1/2007 | Sugiura et al. | |
| 7,169,522 | B2 | 1/2007 | Sugiura et al. | |
| 7,261,989 | B2 | 8/2007 | Sugiura et al. | |
| 7,318,989 | B2 | 1/2008 | Kotsugai et al. | |
| 7,368,212 | B2 | 5/2008 | Sugiura et al. | |
| 2003/0152857 | A1 | 8/2003 | Sugiura et al. | |
| 2004/0067189 | A1 | 4/2004 | Sugiura et al. | |
| 2005/0074685 | A1 * | 4/2005 | Kido et al. | 430/110.2 |
| 2005/0089786 | A1 | 4/2005 | Sugiura et al. | |
| 2006/0024604 | A1 | 2/2006 | Sugiura et al. | |
| 2006/0172217 | A1 * | 8/2006 | Kidokoro | 430/137.15 |
| 2006/0269865 | A1 * | 11/2006 | Oyama | 430/137.11 |
| 2007/0059063 | A1 | 3/2007 | Nakayama et al. | |
| 2007/0140748 | A1 | 6/2007 | Sugiura | |
| 2007/0218392 | A1 * | 9/2007 | Yamada et al. | 430/109.4 |
| 2008/0014527 | A1 | 1/2008 | Kotsugai et al. | |
| 2008/0096116 | A1 | 4/2008 | Utsumi et al. | |
| 2008/0096120 | A1 * | 4/2008 | Yamaguchi et al. | 430/110.2 |
| 2008/0305423 | A1 | 12/2008 | Sugiura et al. | |
| 2010/0173240 | A1 * | 7/2010 | Sensui | 430/108.2 |

FOREIGN PATENT DOCUMENTS

| | | |
|---|---|---|
| JP | 63-271369 | 11/1988 |
| JP | 2002-162860 | 6/2002 |
| JP | 2004-139003 | 5/2004 |
| JP | 2004-354706 | 12/2004 |
| JP | 2006-91564 | 4/2006 |
| JP | 2006-154796 | 6/2006 |
| JP | 2006-178093 | 7/2006 |
| JP | 2006-267199 | 10/2006 |
| JP | 4003877 | 8/2007 |
| JP | 2007-279712 | 10/2007 |
| JP | 2008-33305 | 2/2008 |
| JP | 2008-83258 | 4/2008 |
| WO | WO 2005/074392 A2 | 8/2005 |

OTHER PUBLICATIONS

U.S. Appl. No. 12/091,301, filed Apr. 24, 2008, Hideki Sugiura, et al.
Office Action issued Jul. 9, 2013 in Japanese Application No. 2009-032946.

* cited by examiner

*Primary Examiner* — Thorl Chea
(74) *Attorney, Agent, or Firm* — Oblon, Spivak, McClelland, Maier & Neustadt, L.L.P.

(57) ABSTRACT

A toner containing at least a binder resin and a colorant, wherein the toner has a core-shell structure composed of a core, and a shell having a thickness of 0.01 μm to 2 μm on a surface of the core, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

13 Claims, 9 Drawing Sheets

TONER, DEVELOPER, AND IMAGE FORMING METHOD

BACKGROUND OF THE INVENTION

1. Field of the Invention

The present invention relates to a toner for developing a latent electrostatic image by electrophotography, electrostatic recording, electrostatic printing and the like, and a developer and image forming method using the toner.

2. Description of the Related Art

An image formation by electrophotography is generally performed by a succession of process, in which a latent electrostatic image is formed on a latent electrostatic image bearing member (hereinafter also referred to as "photoconductor"), the latent electrostatic image is developed by a developer containing a toner so as to form a visible image (toner image), and the visible image is transferred on a recording medium such as paper so as to be fix thereon, thereby obtaining a fixed image (U.S. Pat. No. 2,297,691). A full color image formation is, generally, to perform reproduction of colors using toners of four colors consisting of black, yellow, magenta and cyan, wherein each color is developed and a toner image in which toner layers are superimposed on a recording medium is heated and fixed at the same time, so as to obtain a full color image.

However, images by full color copiers cannot satisfy users who are used to see printed images and silver halide photographic images, and are demanded for improvement of quality image, in which high definition and high resolution close to photographs and printing are satisfied. Particularly, when cardboards are used, or high speed printing is performed, heat transfer upon fixing is not sufficient. Thus, it is hard to obtain an image having excellent fixability and high image quality, specifically less variation in glossiness, density and image clarity.

A low temperature fixing system, and a toner corresponds to the system are studied, so that a toner corresponds to the low temperature fixing system can be produced by lowering softening temperature of the toner. However, such toner is not preferable, because the heat resistant storage property thereof becomes poor. A toner is severely influenced by environments such as high temperature and high humidity, low temperature and low humidity or the like, during storage, and transportation after production of the toner. Even after stored in such environments, a toner having excellent storage property, in which toner particles are not aggregated, and charge property, flowability, transfer property and fixing property are not or less degraded, is demanded.

On the other hand, it has been understood that toner spent on a developing member, carrier and the like adversely affects charge property and developing property. A toner which can solve these problems and suitably satisfy low temperature fixability, heat resistant storage property and developing stability, and a developer and image forming apparatus using the toner have not been provided at the moment.

BRIEF SUMMARY OF THE INVENTION

The present invention is to provide a toner having suitable low temperature fixability, heat resistant storage property, developing stability and responsiveness for high speed printing, and a developer and image forming method using the toner.

The inventors of the present invention has diligently studied and found that the suitable low temperature fixability, heat resistant storage property, developing stability and responsiveness for high speed printing of the toner can be secured by producing the toner for developing a latent electrostatic image, which contains at least a colorant and a binder resin, wherein the toner has a core-shell structure composed of a core, and a shell having a thickness of 0.01 μm to 2 μm on a surface of the core, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

The present invention is made based on the findings by the inventors of the present invention, and means for solving the above-mentioned problems are as follows.

<1> A toner containing a binder resin, and a colorant, wherein the toner has a core-shell structure composed of a core, and a shell having a thickness of 0.01 μm to 2 μm on a surface of the core, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

<2> The toner according to <1>, wherein fine resin particles are applied on the surface of the core, and then formed into a layer so as to form the shell.

<3> The toner according to <2>, wherein the fine resin particles 20 have a volume average particle diameter of 120 nm to 670 nm.

<4> The toner according to <1>, wherein the binder resin contains at least a polyester.

<5> The toner according to <1>, wherein the toner contains at least a modified polyester.

<6> The toner according to <1>, wherein the toner is formed by dispersing in an aqueous medium containing the fine resin particles an oil droplet of an organic solvent in which a toner composition containing at least a prepolymer is dissolved, and subjecting to at least one of cross-linking reaction and elongation reaction.

<7> The toner according to <1>, wherein the toner is formed by subjecting a toner composition which contains at least a polymer having a site reactive with a compound having an active hydrogen group, a polyester, a colorant and a releasing agent to at least one of cross-linking reaction and elongation reaction in an aqueous medium in the presence of the fine resin particles.

<8> The toner according to <1>, wherein the toner has an average circularity of 0.93 to 0.99.

<9> The toner according to <1>, wherein the toner has a shape factor SF-1 of 100 to 150, and a shape factor SF-2 of 100 to 140.

<10> The toner according to <1>, wherein the toner has a mass average particle diameter $D_4$ of 2 μm to 7 μm, and a ratio $D_4/Dn$ of 1.25 or less, where $D_4$ is the mass average particle diameter and Dn is a number average particle diameter.

<11> A developer containing a toner and a carrier, wherein the toner contains a binder resin, and a colorant, wherein the toner has a core-shell structure composed of a core, and a shell having a thickness of 0.01 μm to 2 μm on a surface of the core, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

<12> An image forming apparatus containing at least a latent electrostatic image bearing member, a latent electrostatic image forming unit configured to form a latent electrostatic image on the latent electrostatic image bearing member, a developing unit configured to develop the latent electrostatic image using a toner so as to form a visible image, a transferring unit configured to transfer the visible image onto a recording medium, and a fixing unit configured to fix a transferred image onto the recording medium, wherein the toner contains a binder resin; and a colorant, wherein the toner has a core-shell structure composed of a core, and a shell having a thickness of 0.01 μm to 2 μm on a surface of the core, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

<13> The image forming apparatus according to <12>, wherein at least developing units for four developing colors are arranged in tandem, and wherein a linear velocity of a system is 500 mm/sec to 2,500 mm/sec, and a surface pressure of the fixing unit is 5 $N/cm^2$ to 90 $N/cm^2$.

<14> An image forming method including at least forming a latent electrostatic image on a latent electrostatic image bearing member, developing the latent electrostatic image using a toner so as to form a visible image, transferring the visible image onto a recording medium, and fixing a transferred image onto the recording medium by a fixing unit, wherein the toner contains a binder resin, and a colorant, wherein the toner has a core-shell structure composed of a core, and a shell having a thickness of 0.01 μm to 2 μm on a surface of the core, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

<15> A process cartridge containing at least a latent electrostatic image bearing member, and a developing unit configured to develop a latent electrostatic image formed on the latent electrostatic image bearing member using a toner so as to form a visible image, wherein the process cartridge is detachably mounted onto an image forming apparatus, wherein the toner contains a binder resin, and a colorant, wherein the toner has a core-shell structure composed of a core, and a shell having a thickness of 0.01 μm to 2 μm on a surface of the core, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

According to the present invention, conventional problems can be solved, and a toner having suitable low temperature fixability, heat resistant storage property, developing stability and responsiveness for high speed printing, and a developer and image forming method using the toner can be provided.

DETAILED DESCRIPTION OF THE INVENTION (Toner)

Figure 1A:
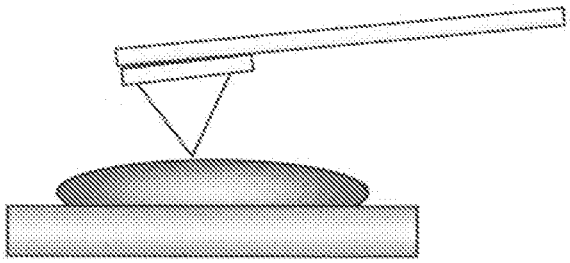
FIGS. 1A to 1C are schematic views showing an example of a measurement method of softening temperatures of a shell and a core.

A toner of the present invention has a core-shell structure consisting of a core and a shell on a surface of the core.

The toner contains at least a binder resin and a colorant, and further contains other components as necessary.

In the present invention, the core allows to design a toner containing a resin having low softening property, thereby having low temperature fixability. The shell can protect the core from wax, pigment and insufficiently-charged components, which adversely affect charge properties of the core and cause toner spent on a carrier and a developing member.

The shell has a thickness of 0.01 μm to 2 μm, and preferably 0.4 μm to 1.5 μm. When the thickness is less than 0.01 μm, the effect of the shell may not be sufficiently exhibited. When the thickness is more than 2 μm, the shell is excessively thick, and the color developing property of a colorant in the core and exudation of wax becomes poor. Moreover, the low temperature fixability of the shell may not be sufficiently secured.

The shell thickness can be measured, for example, by the following methods. In any methods, the shell thickness of randomly selected 10 toners are measured, and an average value thereof is defined as a shell thickness.

(1) Evaluation by Transmission Electron Microscope (TEM)

Firstly, approximately one spatula of a toner is embedded in an epoxy resin, and then the epoxy resin is cured to obtain a sample. The sample is exposed to ruthenium tetroxide for 5 minutes so as to dye a shell and a core for identification. The sample is cut out with a knife to reveal the cross section thereof and an ultra thin section having 200 nm-thick of the toner is prepared by an ultramicrotome (ULTRACUT UCT manufactured by Leica, with the use of a diamond knife). And then, the ultra thin section of the toner is observed by a transmission electron microscope (TEM), H7000 (manufactured by Hitachi High-Technologies Corporation) at an acceleration voltage of 100 kV.

(2) Evaluation by FE-SEM (Scanning Electron Microscope)

Approximately one spatula of a toner is embedded in an epoxy resin, and then the epoxy resin is cured to obtain a sample. The sample is exposed to ruthenium tetroxide for 5 minutes so as to dye a shell and a core for identification. The sample is cut out with a knife to reveal the cross section of the toner and an ultra thin section is prepared by an ultramicrotome (ULTRACUT UCT manufactured by Leica, with the use of a diamond knife). And then, a reflected electron image is observed by a scanning electron microscope (FE-SEM), Ultra55 (manufactured by Carl Zeiss) at an acceleration voltage of 0.8 kV.

(3) Evaluation by SPM

Firstly, approximately one spatula of a toner is embedded in an epoxy resin, and then the epoxy resin is cured to obtain a sample. The sample is cut out with a knife to reveal the cross section of the toner and an ultra thin section is prepared by an ultramicrotome (ULTRACUT UCT manufactured by Leica, with the use of a diamond knife). A scanning probe microscope, MMAFM MULTIMODE SPM unit (manufactured by Veeco Instruments) is used to observe a layer image, which may differ depending on viscoelasticity or adherence, in phase imaging in tapping mode.

In the present invention, a softening temperature of a shell ST and a softening temperature of a core CT measured by a SPM probe with an integrated heater and the ratio of ST to CT satisfies a relation of $1.1 \leq ST/CT \leq 2.0$, and preferably $1.2 \leq ST/CT \leq 1.5$.

When the ST/CT is less than 1.1, the difference between the softening temperatures of the core and the shell is small, causing difficulty in satisfying both the low temperature fixability and the heat resistant storage property. If the low temperature fixability is prioritized over the heat resistant storage property, the toner has excessively low softening point and cannot have suitable heat resistant storage property. On the other hand, when the toner is formed to have a high softening point in order to satisfy the heat resistant storage property, the toner cannot have suitable low temperature fixability. Moreover, it is not preferred that developing stability becomes poor due to occurrence of toner spent on a carrier or the like because the strength of particles cannot be maintained during stirring in a developing unit.

When the ratio of ST/CT is more than 2.0, it is expected that each softening property of the core and shell differs sufficiently, and that both the low temperature fixability and the heat resistant storage property may be exhibited. By contraries, when the difference thereof becomes larger, and the shell becomes hard to be softened, the low temperature fixability cannot be exhibited sufficiently. Moreover, the compatibility and interaction of the core-shell interface cannot be secured sufficiently, and the core and the shell individually functions, thus the toner lacks strength and is not stable enough to be in a form of a particle. As a result, the heat resistant storage property is decreased.

The softening temperature of the core and shell can be measured by the following method.

The softening temperatures of the core and the shell can be measured by a SPM probe with an integrated heater, specifically, by a device in which a thermomechanical analysis (TMA) unit for nano-thermal analysis is interfaced with SPM (also referred to as a nano-TA system). As the scanning probe microscope, MMAFM MULTIMODE SPM unit (manufactured by Veeco Instruments) is used. The nano-TA is a technique of evaluating a softening property (TMA property) and heat properties of a sample by the SPM probe with an integrated heater. The probe, i.e. a cantilever 201 is moved to a sample, i.e. toner 202 measurement position, a chip 203 of the cantilever is raised in temperature, and the deflection value of the cantilever 201 is obtained, so as to obtain subduction corresponding to a chip temperature (see FIG. 1).

FIG. 1A shows the probe 201 contacted with a measurement position on a surface of the sample 202. FIG. 1D is a graph showing an applied temperature on the horizontal axis and cantilever displacement (deflection) amount on the longitudinal axis. A measurement position on a sample surface is searched beforehand by a contact mode or tapping mode atomic force microscope, the probe is set on the measurement position, and then temperature is started to rise.

Figure 1B:
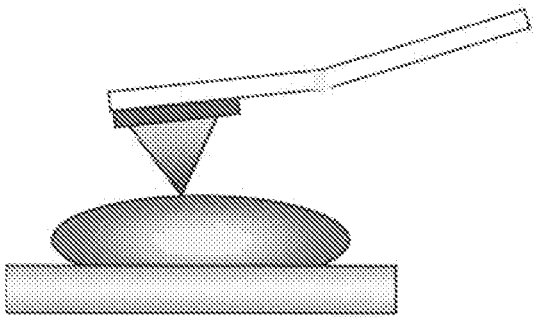
Figure 1C:
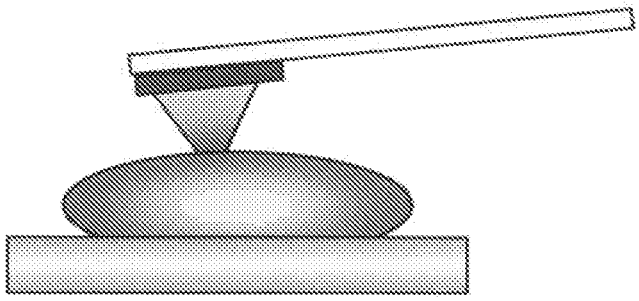
Figure 1D:
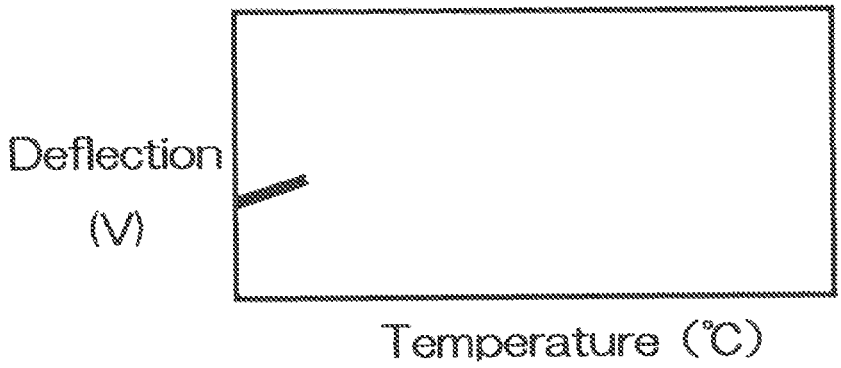
FIGS. 1D to 1F are graphs showing heat-displacement curves respectively corresponding to FIGS. 1A to 1C.
Figure 1E:
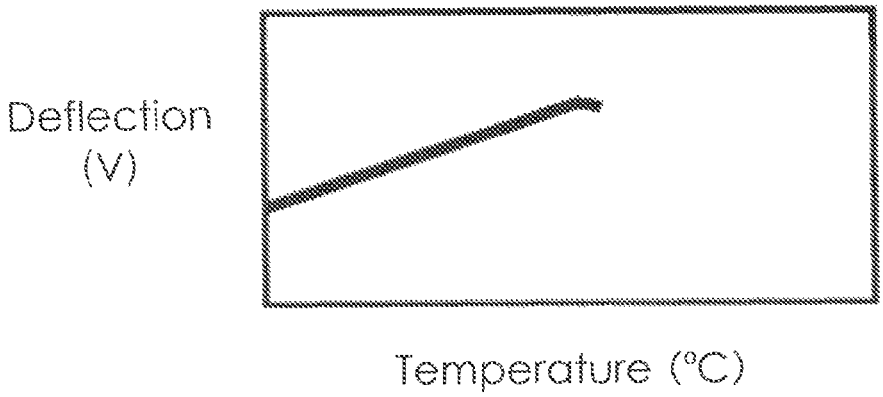
Figure 1F:
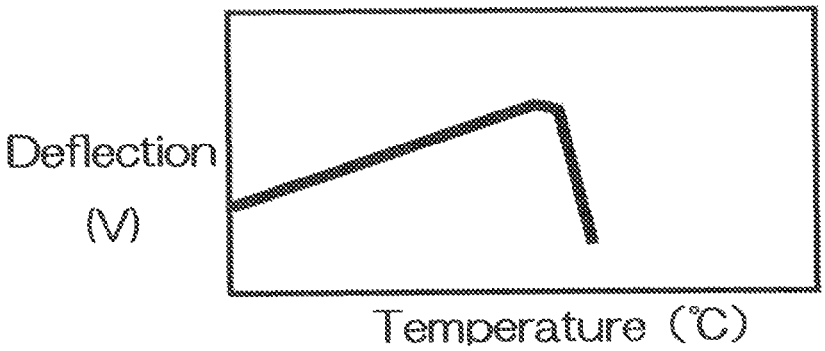

Next, FIG. 1E is a graph showing a temperature change in FIG. 1B. A sample slightly thermally expanded by heating. As a result, as shown in FIG. 1B, the cantilever 201 is displaced (deflection).

FIG. 1C shows a cantilever at a temperature a little over a softening point. When the sample is softened at a certain temperature, a load on the cantilever 201 which has been deflected by thermal expansion is eased, thereby decreasing displacement of the cantilever 201. As a result, an inflection point can be observed in a heat-displacement curve shown in FIG. 1F. The temperature at the inflection point is a softening temperature to be evaluated.

In the nano-TA system, softening property (TMA property) in a targeted position can be evaluated with a resolution of 20 nm by using a special acute cantilever equal to that used in an atomic force microscope. The alignment for measurement can be performed generally by a contact mode or tapping mode atomic force microscope. The softening properties of the shell and core of the toner in a cross section can be respectively evaluated. In view of variation of the measurement results, an average softening temperature of 5 toner particles is evaluated. The temperature rise rate of the cantilever is 5° C./sec.

The temperature applied to the probe by the device is controlled by the voltage applied to the probe. The actual temperature applied to the tip of the probe corresponding to the voltage can be adjusted by calibrating with a standard curve obtained using 3 standard resins of which softening temperatures are known.

Specifically, for example, when three resins having different softening temperatures: Resin A (softening temperature: 50° C.); Resin B (softening temperature: 100° C.); and Resin C (softening temperature: 150° C.) are measured by the nano-TA system, Resin A is softened at 1V, Resin B is softened at 2V, and Resin C is softened at 3V. As a result, it is found that 1V corresponds to the applied temperature of 50° C. Thus, the absolute temperature applied to the probe can be controlled. For example, when a sample is softened at 2V, the softening temperature of the sample is 10° C.

However, actually the voltage and temperature do not provide a complete linear relationship. Therefore, the standard curve is approximated by a cubic curve.

The core-shell structure of the toner is preferably formed in such a manner that fine resin particles are applied on the surface of the core, and then formed into a layer so as to form the shell. Thus, a stable and uniform core-shell structure of the toner can be formed, thereby allowing to stably provide the toner consisting of the shell and core, wherein the core and the shell have different softening temperatures measured by a SPM probe with an integrated heater.

The thickness of the shell layer can be controlled by changing the volume average particle diameter of the fine resin particles. It is understood that the fine resin particles are formed into a layer so as to form the shell in the particle forming process, because the shell cannot be formed if the fine resin particles are not present in the aqueous medium.

The toner contains at least a binder resin and a colorant, and further contains other components as necessary.

The binder resin preferably contains at least a polyester. Thus, the range of heat properties and viscoelasticity of the toner are preferably broaden.

The toner preferably contains at least a modified polyester. Thus, the range of heat properties and viscoelasticity of the toner are preferably broaden.

The toner is preferably formed by dispersing in an aqueous medium containing the fine resin particles an oil droplet of an organic solvent in which a toner composition containing at least a prepolymer is dissolved, and subjecting to cross-linking reaction and/or elongation reaction. Thus, a toner having a core-shell structure can be produced.

The toner is preferably formed by subjecting a toner composition which contains at least a polymer having a site reactive with a compound having an active hydrogen group, a polyester, a colorant and a releasing agent to a cross-linking and/or elongation reaction in an aqueous medium in the presence of fine resin particles. Thus, a toner having a core-shell structure is formed, and having appropriate softening properties inside the shell and core can be preferably formed.

—Polyester—

The polyesters are classified into modified polyester and unmodified polyester. Both of them are preferably used together.

As the modified polyester, for example, a polyester prepolymer having an isocyanate group can be used. Examples of the polyester prepolymer having an isocyanate group (A) include a polyester prepolymer, which is a polycondensation polyester of a polyvalent alcohol (PO) and a polyvalent carboxylic acid (PC) and has an active hydrogen group, is further reacted with polyisocyanate (3). Examples of the active hydrogen group involved into the above-noted polyester include a hydroxyl group (an alcoholic hydroxyl group and a phenolic hydroxyl group), an amino group, a carboxyl group, and a mercapto group. Among these groups, an alcoholic hydroxyl group is preferable.

Examples of the polyols (1) include diols (1-1), trivalent or higher-valent polyols (1-2). Among these, diol (1-1) alone and a mixture of diol (1-1) and a small amount of trivalent or higher-valent polyol (1-2) are preferred. Examples of the diols (1-1) include alkylene glycols such as ethylene glycol, 1,2-propylene glycol, 1,3-propylene glycol, 1,4-butandiol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenols such as bisphenol A, bisphenol F, and bisphenol S; alkylene oxide (such as ethylene oxide, propylene oxide, and butylene oxide) adducts of the above-noted alicyclic diols; and alkylene oxide (such as ethylene oxide, propylene oxide, and butylene oxide) adducts of the above-noted bisphenols. Among these, alkylene glycols having 2 to 12 carbon atoms and alkylene oxide adducts of bisphenols are preferable, and alkylene oxide adducts of bisphenols and a combination of an alkylene glycol having 2 to 12 carbon atoms with the alkylene oxide adduct of bisphenols are particularly preferable. Examples of the trivalent or higher-valent polyols (1-2) include a polyaliphatic alcohol of trivalent to octavalent or higher such as glycerine, trimethylol ethane, trimethylol propane, pentaerythritol, and sorbitol; and trivalent or higher-valent phenols such as trisphenol PA, phenol novolac, and cresol novolac; and alkylene oxide adducts of the trivalent or higher-valent polyphenols.

Examples of the polcarboxylic acids (2) include dicarboxylic acids (2-1) and trivalent or higher-valent polycarboxylic acids (2-2). A dicarboxylic acid (2-1) alone and a mixture of a dicarboxylic acid (2-1) and a small amount of a polycarboxylic acid (2-2) are preferable. Examples of the dicarboxylic acids (2-1) include alkylene dicarboxylic acids such as succinic acid, adipic acid, and sebacic acid; alkenylene dicarboxylic acids such as maleic acid and fumaric acid; aromatic dicarboxylic acids such as phthalic acid, isophthalic acid, terephthalic acid, and naphthalene dicarboxylic acid. Among these, alkenylene dicarboxylic acids having 4 to 20 carbon atoms and aromatic dicarboxylic acids having 8 to 20 carbon atoms are preferable. Examples of the trivalent or higher-valent polycarboxylic acids (2-2) include aromatic polcarboxylic acids having 9 to 20 carbon atoms such as trimellitic acid, and pyromellitic acid. An acid anhydride of the polycarboxylic acids (2) or a lower alkyl ester such as methyl ester, ethyl ester, and isopropyl ester may be reacted with a polyalcohol (1).

The ratio of polyol (1) to polycarboxylic acid (2), defined as an equivalent ratio [OH]/[COOH] of a hydroxyl group [OH] to a carboxyl group [COOH], is typically 2/1 to 1/1, preferably 1.5/1 to 1/1, and more preferably 1.3/1 to 1.02/1.

Examples of the polyisocyanate compound (3) include aliphatic polyisocyanates such as tetramethylene diisocyanate, hexamethylene diisocyanate, and 2,6-diisocyanate methyl caproate; alicyclic polyisocyanates such as isophorone diisocyanate, and cyclohexyl methane diisocyanate; aromatic diisocyanates such as tolylene diisocyanate, and diphenylmethane diisocyanate; aromatic aliphatic diisocyanates such as $\alpha,\alpha,\alpha'\alpha'$-tetramethyl xylylene diisocyanate; isocyanates; a compound in which the above-noted polyisocyanate is blocked with a phenol derivative, oxime, caprolactam, or the like; and combinations thereof.

The ratio of polyisocyanate (3), defined as an equivalent ratio [NCO]/[OH] of an isocyanate group [NCO] to a hydroxyl group [OH] of a polyester having a hydroxyl group, is typically 5/1 to 1/1, preferably 4/1 to 1.2/1, and more preferably 2.5/1 to 1.5/1. When [NCO]/[OH] is more than 5, low-temperature fixability is adversely affected. When the molar ratio of [NCO] is less than 1, the urea content of the modified polyester becomes lower, adversely affecting hot-offset resistance. The component content of polisocyanate (3) in the prepolymer having an isocyanate group at its end (A) is typically 0.5% by mass to 40% by mass, preferably 1% by mass to 30% by mass, and more preferably 2% by mass to 20% by mass. When it is less than 0.5% by mass, hot-offset resistance becomes poor and there appears a disadvantage in satisfying both heat resistant storage property, and low-temperature fixability. On the other hand, when it is more than 40% by mass, low-temperature fixability becomes poor.

The number of isocyanate groups contained in one molecule of the polyester prepolymer having an isocyanate group (A) is typically 1 or more, preferably 1.5 to 3 in average, and more preferably 1.8 to 2.5 in average. When the number of isocyanate groups is less than 1 in one molecule of the polyester prepolymer, the molecular mass of the modified polyester which has been subjected to cross-linking and/or elongation reaction becomes lower, adversely affecting the hot-offset resistance.

In the present invention, as a cross-linking agent and/or elongation agent amines can be used. Examples of amines (B) include diamines (B1), trivalent or higher-valent polyamines (B2), aminoalcohols (B3), amino mercaptans (B4), amino acids (B5), and compounds in which the amino group of B1 to B5 is blocked (B6). Examples of the diamines (B1) include aromatic diamines such as phenylene diamine, diethyl toluene diamine, 4,4'-diamino diphenyl methane; alicyclic diamines such as 4,4'-diamino-3,3'-dimethyl dicyclohexyl methane, diamine cyclohexane, and isophorone diamine; and aliphatic diamines such as ethylene diamine, tetramethylene diamine, and hexamethylene diamine. Examples of the trivalent or higher-valent polyamines (B2) include diethylene triamine and triethylene tetramine. Examples of the aminoalcohols (B3) include ethanol amine, and hydroxyethylaniline. Examples of the amino mercaptans (B4) include aminoethyl mercaptan and aminopropyl mercaptan. Examples of the amino acids (B5) include aminopropionic acid, aminocaproic acid. Examples of the compounds, in which the amino group of B1 to B5 is blocked (B6), include a ketimine compound obtained from the amines of B1 to B5 and ketones such as acetone, methyl ethyl ketone, and methyl isobutyl ketone of B1 to B5; and oxazolidine compound. Among these amines (B), diamines B1 and a mixture of the diamine B1 with a small amount of the trivalent or higher-valent polyamine B2 are preferable.

In cross-linking and/or elongation reaction of the polyester prepolymer (A) and amines (B), a reaction stopper may be used as required to control the molecular mass of a modified polyester to be obtained. Examples of the reaction stoppers include monoamines such as diethyl amine, dibutyl amine, butyl amine and lauryl amine; and compounds in which these are blocked, such as ketimine compounds.

The ratio of amines (B), defined as an equivalent ratio [NCO]/[NHx] of an isocyanate group [NCO] in the polyester prepolymer having an isocyanate group (A) to an amino group [NHx] in amines (B), is typically 1/2 to 2/1, preferably 1.5/1 to 1/1.5, and more preferably 1.2/1 to 1/1.2. When [NCO]/[NHx] is more than 2 or less than ½, the molecular mass of the modified polyester becomes lower, adversely affecting hot-offset resistance.

—Unmodified Polyester—

In the present invention, it is important that not only the modified polyesters alone but also unmodified polyesters may be included together with the modified polyester as toner binder resin components. Use of the modified polyesters with the unmodified polyesters enables to improve low-temperature fixability and glossiness, gloss uniformity when the resulted toner is used in a full-color device. Examples of the unmodified polyesters include polycondensates of polyols (1) and polycarboxylic acids (2), and the like, which are similar to polyester components of the prepolymer having an isocyanate group (A). Preferable compounds thereof are also the same as in the prepolymer having an isocyanate group (A). As for the unmodified polyesters, in addition to unmodified polyesters, they may be polymers modified by a chemical bond other than urea bonds, for example, may be modified by a urethane bond. It is preferable that at least a part of the modified polyester is compatible with a part of the unmodified polyester, from the aspect of low-temperature fixability and hot-offset resistance. Thus, it is preferable that the polyester component of the modified polyester is similar to that of the unmodified polyester. A mass ratio of the modified polyester to the unmodified polyester when a modified polyester being included, is typically 5/95 to 75/25, preferably 10/90 to 25/75, more preferably 12/88 to 25/75, and still more preferably 12/88 to 22/78. When the mass ratio of the modified polyester is less than 5% by mass, hot-offset resistance is adversely affected and it causes disadvantages in satisfying both the heat resistant storage property and low-temperature fixability.

The peak molecular mass of the unmodified polyester is typically 1,000 to 30,000, preferably 1,500 to 10,000, and more preferably 2,000 to 8,000. When the peak molecular mass of the unmodified polyester is less than 1,000, the heat resistant storage property may be poor, and when more than 30,000, the low-temperature fixability may be adversely affected. The hydroxyl value of the unmodified polyester is preferably 5 mgKOH/g or more, more preferably 10 mgKOH/g to 120 mgKOH/g, and still more preferably 20 mgKOH/g to 80 mgKOH/g. When the hydroxyl value is less than 5 mgKOH/g, it causes disadvantages in the compatibility between heat resistant storage property and low-temperature fixability. The acid value of the unmodified polyester is typically 0.5 mgKOH/g to 40 mgKOH/g, and preferably 5 mgKOH/g to 35 mgKOH/g. When the acid value of the unmodified polyester is within the above-mentioned range, the resulted toner tends to be negatively charged. Moreover, the unmodified polyester has the acid value and hydroxyl value outside these ranges, the resulted toner may be easily influenced by the environment, and an image may be easily degraded either under high temperature and high humidity, or low temperature and low humidity.

The glass transition temperature (Tg) of the toner is preferably 40° C. to 70° C., and more preferably 45° C. to 55° C. When the glass transition temperature (Tg) is lower than 40° C., the heat resistant storage property degrades, and when higher than 70° C., the low-temperature fixability becomes insufficient. The toner of the present invention shows a proper heat resistant storage property even with a low glass transition temperature, compared to a toner made from conventional polyesters, because the toner contains a cross-linked and/or elongated polyester. As for storage elastic modulus of the toner, the temperature (TG') at which the storage elastic modulus of the toner is 10,000 dyne/cm$^2$ at a frequency of 20 Hz is preferably 100° C. or higher, and more preferably 110° C. to 200° C. When the temperature (TG') is lower than 100° C., the hot offset resistance degrades. As for the viscosity of the toner, the temperature (Tη) at which the viscosity of the binder resin becomes 1,000 poises at a frequency of 20 Hz is preferably 180° C. or lower, and more preferably 90° C. to 160° C. When the temperature (Tη) is higher than 180° C., the low-temperature fixability degrades. Therefore, from the viewpoint of satisfying both low temperature fixability and hot offset resistance, it is preferable that TG' be higher than Tη. In other words, a difference of TG' minus Tη (TG'−Tη) is preferably 0° C. or higher, more preferably 10° C. or higher, and particularly preferably 20° C. or higher. The upper limit of the difference is not restricted. More specifically, from the viewpoint of satisfying both heat resistant storage property and low temperature fixability, the difference of TG' minus Tη (TG'−Tη) is preferably 0° C. to 100° C., more preferably 10° C. to 90° C., and particularly preferably 20° C. to 80° C.

—Colorant—

The colorant is not particularly limited and may be appropriately selected depending on the intended purpose. Examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone and magnetite.

The amount of the colorant is preferably 1% by mass to 15% by mass, and more preferably 3% by mass to 10% by mass, based on the toner.

The colorant may be combined with a resin so as to be used as a master batch. Examples of binder resins for use in the production of the master batch or in kneading with the master batch include, in addition to the above-noted modified or unmodified polyesters, styrene or polymers of substitutes thereof such as polystyrene, poly-p-chlorostyrene, and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, and paraffin wax. These resins may be used alone or in combination.

The master batch can be produced by mixing and kneading the master batch resin and the colorant under high shearing force. In this process, to enhance interaction between colorants and resins, an organic solvent is preferably added. Furthermore, the so-called flushing method is preferred in that a wet cake of the colorant can be used as it is, and no drying is needed. In this flushing method, an aqueous paste containing the colorant is mixed and kneaded with a resin and organic solvent, and the colorant is made to transfer to the resin side to remove water and organic solvent components. In the mixing and kneading, a high shearing dispersion apparatus, for example, a three-roll mill is preferably used.

—Releasing Agent—

The releasing agent is not particularly limited and may be appropriately selected from those know in the art. Examples thereof include polyolefine waxes such as polyethylene wax, polypropylene wax, etc.; long chain hydrocarbons such as paraffin wax, sazole wax, etc.; and carbonyl group-containing waxes. Among these, carbonyl group-containing waxes are preferable.

Examples of the carbonyl group-containing waxes include polyalkanoic esters such as carnauba wax, montan wax, trimethylol propane tribehenate, pentaerythritol tetrabehenate, pentaerythritol diacetate behenate, glycerine tribehenate, 1,18-octadecandioldistearate, etc.; polyalkanol esters such as trimellitic tristearyl, distearyl maleate, etc.; polyalkanoic amides such as ethylenediamine dibehenylamide, etc.; polyalkylamides such as trimellitic acid tristearylamide; and distearylketones such as distearylketones. Among these carbonyl group-containing waxes, polyalkanoic esters are preferable.

The melting point of the wax is preferably 40° C. to 160° C., more preferably 50° C. to 120° C., and still more preferably 60° C. to 90° C. A wax having a melting point of lower than 40° C. adversely affects the heat resistant storage property, and a wax having a melting point of higher than 160° C. is likely to cause cold-offset at the time of fixing. The melt viscosity of the wax is preferably 5 cps to 1,000 cps, and more preferably 10 cps to 100 cps, as a value measured at a temperature 20° C. higher than the melting point of the wax. A wax having a melt viscosity higher than 1,000 cps has less effects on improving the hot offset resistance and low temperature fixability.

The amount of the wax contained in the toner is preferably 40% by mass or less, and more preferably 3% by mass to 30% by mass.

—Fine Resin Particles—

The fine resin particles preferably have a glass transition temperature (Tg) of 40° C. to 100° C., and a mass average molecular mass of 9,000 to 200,000. When the glass transition temperature (Tg) is less than 40° C. and/or the mass average molecular mass is less than 9,000, the storage property of the toner may be degraded, causing blocking during storage and in a developing unit. On the other hand, when the glass transition temperature (Tg) is more than 100° C. and the mass average molecular mass is more than 200,000, the fine resin particles may inhibit adhesion to fixation paper, and a lower limit of fixing temperature may be increased.

Moreover, the residual rate of the fine resin particles to the toner is preferably 0.5% by mass to 5.0% by mass. When the residual rate is less than 0.5% by mass, the storage stability of the toner may be degraded, and blocking may occur during storage and in a developing unit. When the residual rate is more than 5.0% by mass, the fine resin particles may inhibit exudation of wax, and the effect of releasability of wax cannot be obtained, occurring offset.

The residual rate of the fine resin particles can be measured by analyzing a substance which is not derived from toner particles but from fine resin particles using a pyrolysis gas chromatography mass spectrometer, and then calculating from its peak area. As a detector, a mass spectrometer is preferable.

The fine resin particles are not particularly limited as long as they are resins capable of forming an aqueous dispersion and may be appropriately selected depending on the intended purpose. The fine resin particles may be thermoplastic resins or thermosetting resins. Examples thereof include vinyl resins, polyurethane resins, epoxy resins, polyester resins, polyamide resins, polyimide resins, silicone resins, phenol resins, melamine resins, urea resins, aniline resins, ionomer resins, and polycarbonate resins. They may be used alone or in combination. Among these, from the standpoint that an aqueous dispersion of fine resin particles having fine spherical shapes are easy to obtain, it is preferable that fine resin particles are made of vinyl resins, polyurethane resins, epoxy resins, polyester resins or combinations thereof.

Moreover, the vinyl resins are polymers obtained by polymerization or copolymerization of vinyl monomers. Examples thereof include styrene-(meth)acryl ester resins, styrene-butadiene copolymers, (meth)acrylic acid-acryl ester copolymers, styrene-acrylonitrile copolymers, styrene-maleic anhydride copolymers, and styrene-(meth)acrylic acid copolymers.

The fine resin particles have a volume average particle diameter of preferably 120 nm to 670 nm, and more preferably 200 nm to 600 nm. When the volume average particle diameter is less than 120 nm, the thickness of the shell layer becomes thin, and the core-shell structure may not be satisfactorily formed. When the volume average particle diameter is more than 670 nm, the thickness of the shell layer becomes too thick, and the low temperature fixability may not be sufficiently exhibited.

The volume average particle diameter can be measured by a particle size distribution measurement device (LA-920, manufactured by HORIBA, Ltd.), or the like.

—Other Components—

The other components are not particularly limited and may be appropriately selected depending on the intended purpose. Examples thereof include a charge controlling agent, external additives, flowability improver, cleanability improver, magnetic materials, and metal soap.

A charge controlling agent may be added in the toner of the invention, as necessary. The charge controlling agent is not particularly limited and may be appropriately selected from those known in the art. Examples thereof include nigrosine dyes, triphenylmethane dyes, chromium-containing metal complex dyes, molybdenum chelate pigments, rhodamine dyes, alkoxy amines, quaternary ammonium salts (including fluorine-modified quaternary ammonium salts), alkylamide, phosphorous monomers and compounds, tungsten monomers and compounds, fluorine activators, salicylic metal salts, and metal salts of salicylate derivatives. Specific examples thereof include Bontron 03 composed of a nigrosine dye, BONTRON P-51 composed of quaternary ammonium salt, Bontron S-34 composed of a metal containing azo dye, E-82 composed of oxynaphthoic metal complex, E-84 composed of salicylic metal complex, and E-89 composed of phenol condensate (all manufactured by Orient Chemical Industries, Ltd.); TP-302 and TP-415 each composed of molybdenum complex of quaternary ammonium salt (manufactured by Hodogaya Chemical Co.); COPY CHARGE PSY VP2038 composed of quaternary ammonium salt, COPY BLUE PR composed of triphenyl methane derivative, COPY CHARGE NEG VP2036 and COPY CHARGE NX VP434 each composed of quaternary ammonium salt (manufactured by Hoechst Corporation); LRA-901, and LR-147 (boron complex) (all manufactured by Japan Carlit Co., Ltd.); copper phthalocyanine, perylene, quinacridone, azo pigments; and polymer compounds having a functional group such as sulfonic acid group, carboxyl group, and quaternary ammonium salt.

The amount of the charge controlling agent depends on the toner production method including a type of the binder resin, the presence or absence of optionally used additives and a dispersion method. It is preferably 0.1 parts by mass to 10 parts by mass, and more preferably 0.2 parts by mass to 5 parts by mass, based on 100 parts by mass of the binder resin. When the amount exceeds 10 parts by mass, the charge property of the toner is excessively large, the effect of the charge controlling agent is reduced, and the electrostatic suction power to the development roller is increased, resulting in flowability reduction of the developer and poor image density. These charge controlling agent may be dissolved and dispersed after melted and kneaded with the master batch or the resin, may be added when dissolved and dispersed directly in the organic solvent, or may be fixed on a toner surface after production of toner particles The external additives may be used in combination with inorganic fine particles or hydrophobized inorganic fine particles, in addition to fine oxide particles. The hydrophobized inorganic fine particles have an average primary particle diameter of preferably 1 nm to 100 nm, and more preferably 5 nm to 70 nm.

The external additives preferably contain at least one type of the hydrophobized inorganic fine particles having an average primary particle diameter of 20 nm or less and at least one type of the hydrophobized inorganic fine particles having an average primary particle diameter of 30 nm or more. Moreover, the hydrophobized inorganic fine particles preferably have a BET surface area of 20 $m^2/g$ to 500 $m^2/g$.

The external additive is not particularly limited and may be appropriately selected from those known in the art depending on the intended purpose. Examples thereof including silica fine particles, hydrophobic silica; fatty acid metal salts such as zinc stearate and aluminum stearate; metal oxides such as titania, alumina, tin oxide and antimony oxide; and fluoropolymers.

Examples of preferable additives include hydrophobized silica, titania, titanium oxide and alumina fine particles. Examples of the silica fine particles include HDK H 2000, HDK H 2000/4, HDK H 2050EP, HVK21, HDK H 1303 (by Hoechst Co.), R972, R974, RX200, RY200, R202, R805 and R812 (by Nippon Aerosil Co.). Examples of the titania fine particles include P-25 (by Nippon Aerosil Co.), STT-30, STT-65C-S (by Titanium Industries Ltd.), TAF-140 (by Fuji Titanium Industry, Co.), MT-150W, MT-500B, MT-600B and MT-150A (by Tayca Co.).

Examples of the hydrophobized titanium oxide fine particles include T-805 (by Nippon Aerosil Co.), STT-30A, STT-65S-S (by Titanium Industries Ltd.), TAF-500T, TAF-1500T (by Fuji Titanium Industry, Co. Ltd.), MT-100S, MT-100T (by Tayca Co.), and IT-S (by Ishihara Sangyo Kaisha Ltd.)

The hydrophobized oxide fine particles of silica, titania or alumina may be produced by treating the hydrophilic fine particle with silane coupling agents such as methyltrimethoxysilane, methyltriethoxysilane and octyltrimethoxysilane. In addition, silicone oil-treated oxide fine particles or inorganic fine particles are available, which are treated with a silicone oil by heating as necessary.

Examples of the silicone oils include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic or methacrylic-modified silicone oil, and alpha-methylstyrene-modified silicone oil. Examples of the inorganic fine particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. Among these, silica and titanium dioxide are particularly preferable. The amount of the external additives is preferably 0.1% by mass to 5% by mass, more preferably 0.3% by mass to 3% by mass, based on the toner. The inorganic fine particles have an average primary particle diameter of preferably 100 nm or less, more preferably 3 nm to 70 nm. In case where the average primary particle diameter is less than the range, the inorganic fine particles tend to be embedded into toners to hide the effective performance; and when the diameter is larger than the range, the photoconductor surface is likely to be damaged nonuniformly.

The flowability improver is added for surface-treating the toner to increase the hydrophobicity and is capable of preventing the flowability and the charge property of the toner from degradation in a high-humidity environment. Examples of the flowability improver include silane coupling agents, silylation agents, fluorinated alkyl group-containing silane coupling agents, organo-titanium coupling agents, aluminum coupling agents, silicone oils, and modified silicone oils. The silica and titanium oxide may be surface treated with the flowability improver, and used as a hydrophobic silica and hydrophobic titanium oxide.

The toner may also contain a cleanability improver to remove developers remaining on a photoconductor or primary transferred medium after transferring. Examples of the cleanability improver include fatty acid metal salts such as zinc stearate, stearic acid calcium and stearic acid; and polymer fine particles produced through soap-free-emulsion polymerization such as polymethylmethacrylate fine particles and polystyrene fine particles. Those polymer fine particles preferably have a narrower particle size distribution and a volume average particle diameter of 0.01 μm to 1 μm.

The magnetic material is not particularly limited and may be appropriately selected from those known in the art depending on the intended purpose. Examples thereof include iron powder, magnetites and ferrite. Among these, white ones are preferable in terms of color tone.

<Method for Producing Toner>

The toner of the present invention can be produced by subjecting a toner composition containing a polymer having a site reactive with a compound having an active hydrogen group, a polyester, a colorant and a releasing agent to a cross-linking and/or elongation reaction in an aqueous medium in the presence of fine resin particles.

Specifically, polyol (1) and polycarboxylic acid (2) are heated at 150° C. to 280° C. in the presence of an esterified catalyst such as tetrabutoxy titanate, and dibutyltin oxide, and water is distilled away with reducing the pressure if necessary to thereby obtain a polyester containing a hydroxyl group. Next, polyisocyanate (3) is reacted at 40° C. to 140° C. to obtain a polyester prepolymer having an isocyanate group (A).

An aqueous medium used in the present invention is used by adding the fine resin particles therein in advance. Water used in the aqueous medium may be singularly used, or a solvent miscible in water may be used in combination with water. Examples of the solvent miscible in water include alcohols such as methanol, isopropanol, ethylene glycol, etc., dimethylformamide, tetrahydrofuran, cellosolves such as methyl cellosolve, etc. and lower ketones such as acetone, methyl ethyl ketone, etc.

The amount of the fine resin particles in the aqueous medium is not particularly limited and may be appropriately selected depending on the intended purpose. For example, it is preferably 0.5% by mass to 10% by mass.

The toner particles may be formed by reacting amines (B) with a dispersion composed of a polyester prepolymer having an isocyanate group (A) dissolved and/or dispersed in an organic solvent in an aqueous phase. As a method of stably forming the dispersion of the polyester prepolymer (A) in an aqueous medium, a method is exemplified in which a toner material composition of the polyester prepolymer (A) dissolved or dispersed in an organic solvent is added to an aqueous medium, and the dispersion is dispersed by a shearing force. The polyester prepolymer (A) dissolved and/or dispersed in an organic solvent and the other toner composition (hereinafter also referred to as "toner materials") such as a colorant, a colorant master batch, a releasing agent, a charge controlling agent, an unmodified polyester and the like may be mixed together in an aqueous phase to form a dispersion, but it is preferable that the toner materials be mixed beforehand and dissolved and/or dispersed in an organic solvent, and then the mixture be added to and dispersed in the aqueous phase. The other toner materials such as a colorant, a releasing agent, and a charge controlling agent are not necessarily mixed when particles are formed in the aqueous phase, and such materials may be added after particles are formed. For example, after particles containing no colorant are formed, a colorant can be added by a conventionally known dyeing method.

The dispersing method is not particularly limited and may be appropriately selected depending on the intended purpose. Known devices using low-speed shearing mode, high-speed shearing mode, frictional mode, high-pressure jet mode, ultrasonic mode or the like can be used. In order to make the dispersion have a dispersed particle diameter of 2 μm to 20 μm, it is preferable to employ a high-speed shearing mode. When a high-speed shearing dispersing device is used, the number of revolutions is not particularly limited, but it is preferably 1,000 rpm to 30,000 rpm, and more preferably 5,000 rpm to 20,000 rpm. The dispersion time is not particularly limited, but when a batch mode is employed, it is typically 0.1 minutes to 5 minutes. The temperature of the system during the dispersion is preferably 0° C. to 150° C. (under pressurization) and more preferably 40° C. to 98° C. Within the temperature range, a higher temperature is preferable in that the dispersion of the polyester prepolymer (A) has low viscosity, and is easily dispersed.

The amount of the aqueous phase is preferably 50 parts by mass to 2,000 parts by mass, more preferably 100 parts by mass to 1,000 parts by mass based on 100 parts by mass of the toner composition containing the polyester prepolymer (A).

When the amount of the aqueous phase is less than 50 parts by mass, the toner composition is not sufficiently dispersed, and toner particles having predetermined particle diameter may not be obtained. When the amount is more than 2,000 parts by mass, it is economically disadvantageous. Further, a dispersant may be used as necessary. It is preferable to use a dispersant in that the particle size distribution becomes sharp and the dispersed state is stable.

The dispersant is not particularly limited and may be appropriately selected depending on the intended purpose. Examples thereof include surfactants, dispersants composed of an inorganic compound hardly soluble in water, polymeric protective colloids. These may be used alone or in combination. Among these, surfactants are preferable.

Examples of the surfactants include anionic surfactants, cationic surfactants, nonionic surfactants and amphoteric surfactants.

Examples of the anionic surfactants include alkylbenzene sulfonate, α-olefin sulfonate, and phosphoric ester. Among these, anionic surfactants having fluoroalkyl groups are preferable. Examples of the anionic surfactants having fluoroalkyl groups include fluoroalkyl carboxylic acids having from 2 to 10 carbon atoms and metal salts thereof, disodium perfluorooctansulfonylglutamate, sodium 3-[omega-fluoroalkyl ($C_6$-$C_{11}$)oxy]-1-alkyl($C_3$-$C_4$) sulfonate, sodium 3-[omega-fluoroalkanoyl($C_6$-$C_8$)-N-ethylamino]-1-propansulfonate, fluoroalkyl($C_{11}$-$C_{20}$) carboxylic acids and metal salts thereof, perfluoroalkyl ($C_7$-$C_{13}$)carboxylic acids and metal salts thereof, perfluoroalkyl($C_4$-$C_{12}$)sulfonate and metal salts thereof, perfluorooctanesulfonic acid diethanol amide, N-propyl-N-(2-hydroxyethyl)perfluorooctanesulfone amide, perfluoroalkyl($C_6$-$C_{10}$) sulfoneamidepropyltrimethylammonium salts, perfluoroalkyl($C_6$-$C_{10}$)-N-ethylsulfonyl glycin salts, and monoperfluoroalkyl($C_6$-$C_{16}$)ethylphosphates. Examples of commercially available products of the surfactants having fluoroalkyl groups include SURFLON S-111, S-112 and S-113 (manufactured by Asahi Glass Co., Ltd.); FLORARD FC-93, FC-95, FC-98 and FC-129 (manufactured by Sumitomo 3M Ltd.); UNIDYNE DS-101 and DS-102 (manufactured by Daikin Industries, Ltd.); MEGAFAC F-110, F-120, F-113, F-191, F-812 and F-833 (manufactured by Dainippon Ink and Chemicals, Inc.); EFTOP EF-102, 103, 104, 105, 112, 123A, 123B, 306A, 501, 201 and 204 (manufactured by Tohchem Products Co., Ltd.); and FTERGENT F-100 and F150 (manufactured by Neos).

Examples of the cationic surfactants include amine salt surfactants, cationic surfactants of quaternary ammonium salt and cationic surfactants having a fluoroalkyl group. Examples of the amine salt surfactants include alkyl amine salts, aminoalcohol fatty acid derivatives, polyamine fatty acid derivatives and imidazoline. Examples of cationic surfactants of the quaternary ammonium salt include alkyltrimethyl ammonium salts, dialkyldimethyl ammonium salts, alkyldimethyl benzyl ammonium salts, pyridinium salts, alkyl isoquinolinium salts and benzethonium chloride. Example of the cationic surfactants having a fluoroalkyl group include primary, secondary and tertiary aliphatic amino acids having a fluoroalkyl group, aliphatic quaternary ammonium salts such as perfluoroalkyl($C_6$-$C_{10}$) sulfoneamidepropyltrimethylammonium salts, benzalkonium salts, benzetonium chloride, pyridinium salts, and imidazolinium salts.

Examples of commercially available products of these cationic surfactants include SURFLON S-121 (manufactured by Asahi Glass Co., Ltd.); FLORARD FC-135 (manufactured by Sumitomo 3M Ltd.); UNIDYNE DS-202 (manufactured by Daikin Industries, Ltd.); MEGAFAC F-150 and F-824 (manufactured by Dainippon Ink and Chemicals, Inc.); EFTOP EF-132 manufactured by Tohchem Products Co., Ltd.); and FTERGENT F-300 (manufactured by Neos).

Examples of non-ionic surfactants include fatty acid amide derivatives and polyhydric alcohol derivatives.

Examples of the amphoteric surfactants include alanine, dodecyldi(aminoethyl)glycin, di(octylaminoethyle)glycin, and N-alkyl-N,N-dimethylammonium betaine.

Examples of the dispersants composed of an inorganic compound hardly soluble in water include tricalcium phosphate, calcium carbonate, titanium oxide, colloidal silica, and hydroxyapatite.

Examples of the polymeric protection colloids include acids, (meth)acrylic monomers containing hydroxyl groups, vinyl alcohol or ethers of vinyl alcohol, esters of vinyl alcohol with a compound having a carboxyl group, amide compounds or methylol compounds thereof, chlorides, homopolymers or copolymers such as those containing nitrogen atoms or heterocycles thereof, polyoxyethylenes, and celluloses.

Examples of the acids include acrylic acid, methacrylic acid, α-cyanoacrylic acid, α-cyanomethacrylic acid, itaconic acid, crotonic acid, fumaric acid, maleic acid and maleic anhydride. Examples of the (meth)acrylic monomers having the hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide. Examples of the vinyl alcohol and ethers of vinyl alcohol include vinyl methyl ether, vinyl ethyl ether and vinyl propyl ether. Examples of the esters of vinyl alcohol with a compound having a carboxyl group include vinyl acetate, vinyl propionate and vinyl butyrate. Examples of the amide compounds or methylol compounds thereof include acrylamide, methacrylamide and diacetoneacrylamide acid or methylol compounds thereof. Examples of the chlorides include acrylic acid chloride and methacrylic acid chloride. Examples of the homopolymers or copolymers such as contain the nitrogen atoms or heterocycles thereof include vinyl pyridine, vinyl pyrrolidone, vinyl imidazole and ethylene imine. Examples of the polyoxyethylenes include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters. Examples of the celluloses include methyl cellulose, hydroxyethyl cellulose and hydroxypropyl cellulose.

In preparation of the dispersion, a dispersion stabilizer may be used as necessary.

Examples of the dispersion stabilizers include those soluble in acid and alkali, such as calcium phosphate.

In the case of using the dispersion stabilizers, calcium phosphate can be removed from fine particles by a method in which calcium phosphate is dissolved in an acid such as hydrochloric acid and washed with water, or a method of being decomposed with enzymes.

In preparation of the dispersion, catalysts for the elongation reaction and/or the cross-linking reaction may be used. Examples of the catalysts include dibutyltin laurate and dioctyltin laurate.

An organic solvent is removed from a dispersion (emulsified slurry) having been obtained. This organic solvent is removed by the method (1) in which the whole reaction system is warmed by degrees to completely evaporate and remove the organic solvent in the oil droplets, and the method (2) in which an emulsified dispersion is atomized in a dry atmosphere, and a nonaqueous organic solvent in oil droplets is completely removed to form toner fine particles, and an aqueous dispersant is evaporated so as to be removed.

After the organic solvent is removed, toner particles are provided. With respect to these toner particles, washing and drying can be performed, and thereafter classification can be performed as desired. The classification is performed in a liquid by removing fine particle parts with a cyclone, decanter, and centrifugal separator. The classification operation may be performed after the toner is obtained as a powder after drying.

Subsequently, a maturing step is preferably performed in order to control hollow state inside the toner, at a temperature of preferably 30° C. to 55° C., and more preferably 40° C. to 50° C., preferably for 5 hours to 36 hours and more preferably for 10 hours to 24 hours.

When the particle size distribution is widened in the emulsification-dispersion process, and the system is washed and dried with keeping the particle size distribution, and the particle size distribution can be controlled by classifying into a desired particle size distribution.

The classification is performed in a liquid by removing fine particle parts with a cyclone, decanter, and centrifugal separator. The classification operation may be performed after a toner is obtained as a powder by drying, but preferably performed in a liquid in terms of efficiency. Obtained unnecessary fine particles or coarse particles can be returned again to a kneading step for use in formation of particles. At that time, fine particles or coarse particles may be in a wet state.

The thus obtained toner particles are mixed along with particles of the colorant, releasing agent, and the charge controlling agent, and further applied with a mechanical impact, so that particles such as the releasing agent and the like can be prevented from separating from the toner particle surface.

The methods of applying the mechanical impact include, for example, a method of applying an impact to a mixture by vanes in rotation at high speed, and a method in which the mixture is put in a high-speed air current to be accelerated so as to make particles collide with each other, or so as to make complex particles collide to a suitable collision plate. Examples of apparatuses for use in these methods include an angmill (manufactured by Hosokawa Micron Corporation), an I-type mill (manufactured by Nippon Pneumatic MFG., Co., Ltd.), which is reconstructed in reduced pulverizing air pressure, a hybridization system (manufactured by Nara Machine Corporation), Kryptron System (manufactured by Kawasaki Heavy Industries, Ltd.), and automatic mortars.

The toner of the present invention is not particularly limited in its shape, size and the like, and may be appropriately selected depending on the intended purpose. The toner preferably have an average circularity, shape factors SF-1 and SF-2, mass average particle diameter, ratio of mass average particle diameter to number average particle diameter (mass average particle diameter/number average particle diameter) and the like, which will be explained below.

The toner has an average circularity of 0.93 to 0.99, so that the core-shell structure of the toner can be secured to be in a properly substantially spherical shape.

The average circularity of the toner is defined by the following equation:

Average circularity=(circumferential length of a circle having the same area as that of a projected area of a toner particle/circumferential length of the projected image of the toner particle)×100%

The average circularity of the toner can be measured by a flow particle image analyzer, FPIA-2100 manufactured by SYSMEX Corp. using an analysis software (FPIA-2100, Data Processing Program for FPIA version00-10). Specifically, in a 100 mL glass beaker, 0.1 mL to 0.5 mL of a surfactant, preferably alkylbenzene sulfonate (NEOGEN SC-A manufactured by DAI-ICHI KOGYO SEIYAKU CO., LTD.) is loaded, approximately 0.1 g to 0.5 g of each toner is further added and stirred with a micro spatula, and then 80 ml of ion-exchanged water is added. Next, the obtained dispersion liquid is dispersed by an ultrasonic dispersion device (HONDA ELECTRONICS) for about 3 minutes. The shape and distribution of the toner are measured using FPIA-2100, until the concentration of the dispersion liquid becomes 5,000/μL to 15,000/μL.

In the measurement method, it is important that the concentration of the dispersion liquid is 5,000/μL to 15,000/μL in terms of measurement reproducibility of the average circularity. In order to obtained the above-mentioned concentration of the dispersion liquid, the conditions of the dispersion liquid, i.e. the amount of surfactant and toner to be added are necessary to change. The amount of the surfactant differs depending on the hydrophobicity of the toner, as in the measurement of the toner particle diameter. The addition of excessive amount of the surfactant may cause noise due to bubbles. The addition of less amount of the surfactant cannot sufficiently get the toner wet, causing insufficient dispersion. The amount of the toner differs depending on particle diameters. A small particle diameter needs small amount of the toner, on the other hand, a large particle diameter needs large amount of the toner. When the toner has a mass average particle diameter of 2 μm to 7 μm, the concentration of the dispersion liquid can be 5,000/μL to 15,000/μL by adding 0.1 g to 0.5 g of the toner.

When the toner preferably has a shape factor SF-1 of 100 to 150, and a shape factor SF-2 of 100 to 140, the core-shell structure of the toner can be secured in a properly substantially spherical shape.

The shape factor SF-1 and SF-2 of the toner is defined by the following method: An FE-SEM image of a toner is taken by FE-SEM (S-4200) manufactured by Hitachi High-Technologies Corporation, and 300 FE-SEM images are randomly sampled and the image information thereof are introduced into an image analyzer, Luzex AP (manufactured by NIRECO CORPORATION) through an interface, and analyzed and calculated by the following equations. The values of SF-1 and SF-2 are preferably obtained by Luzex. However, other than the FE-SEM device and the image analyzer, any devices can be used as long as the similar analysis results can be obtained.

$$SF\text{-}1=(L2/A)\times(\pi/4)\times100$$

$$SF\text{-}2=(P2/A)\times(1/4\pi)\times100$$

where, L represents the absolute maximum length of a toner, A represents a projected area of the toner, and P represents the maximum perimeter length of the toner. When the toner has a spherical shape, L, A, and P are 100. As a value increases from 100, the spherical shape changes to an indeterminate shape. Particularly, SF-1 represents the entire shape of a toner, i.e. ellipse, sphere or the like, and SF-2 represents a degree of irregularity of a surface of the toner.

The toner has a mass average particle diameter $D_4$ of preferably 2 μm to 7 μm, and more preferably 2 μm to 5 μm. The ratio of the mass average particle diameter $D_4$ to the number average particle diameter Dn ($D_4$/Dn) is preferably 1.25 or less, and more preferably 1.15 or less. Thus, toner particles having a uniform core-shell structure can be preferably formed, in which electrostatic developing property, transfer property, and fixability of the toner are secured.

The mass average particle diameter $D_4$, number average particle diameter Dn and the ratio therebetween ($D_4$/Dn) can be measured by COULTER COUNTER TA-II, COULTER MULTISIZER II (both manufactured by Beckman Coulter, Inc.) or the like. In the present invention, COULTER MULTISIZER II is used. The measurement method will be explained as follows.

Firstly, in 100 mL to 150 mL of an electrolytic aqueous solution, 0.1 mL to 5 mL of a surfactant (preferably, polyoxyethylene alkyl ether (nonionic surfactant)) as a dispersant is added. The electrolytic aqueous solution is a 1% by mass of NaCl aqueous solution using a primary sodium chloride, for example, ISOTON-II (manufactured by Coulter Co.). After addition of the surfactant, 2 mg to 20 mg of a measurement sample is further added to the electrolytic aqueous solution. The electrolytic solution with the sample suspended therein is dispersed by a ultrasonic dispersion device for approximately 1 minute to 3 minutes. The mass and the number of the toner particles or toner are measured by the measurement device using an aperture having a diameter of 100 μm, and a mass distribution and a number distribution are calculated. From the obtained distributions, the mass average particle diameter $D_4$ and the number average particle diameter Dn can be determined.

For channels used in the measurement device, the following 13 channels were used, and particles having a particle diameter of 2.00 μm or more to less than 40.30 μm are intended to be measured: a channel of 2.00 μm or more to less than 2.52 μm; a channel of 2.52 μm or more to less than 3.17 μm; a channel of 3.17 μm or more to less than 4.00 μm; a channel of 4.00 μm or more to less than 5.04 μm; a channel of 5.04 μm or more to less than 6.35 μm; a channel of 6.35 μm or more to less than 8.00 μm; a channel of 8.00 μm or more to less than 10.08 μm; a channel of 10.08 μm or more to less than 12.70 μm; a channel of 12.70 μm or more to less than 16.00 μm; a channel of 16.00 μm or more to less than 20.20 μm; a channel of 20.20 μm or more to less than 25.40 μm; a channel of 25.40 μm or more to less than 32.00 μm and a channel of 32.00 μm or more to less than 40.30 μm.

(Developer)

A developer of the present invention contains at least the toner of the present invention, and further contains other components appropriately selected such as carrier. The developer may be one-component developer, or a two-component developer. In the case of being used in high-speed printers that meet the needs of higher information processing speed in recent years, the two-component developer is preferred in terms of long life.

In the case of the two-component developer using the toner of the present invention, even though inflow and outflow of toner is conducted over a long time period, the variation of toner particle diameters in a developer is small, and an excellent and stable developing property can be obtained even in a developing unit with stirring for a long time period.

The carrier is not particularly limited and may be appropriately selected depending on the intended purpose, and preferably includes a core and a resin layer coating the core.

The core material is not particularly limited and may be appropriately selected from those known in the art. For example, 50 emu/g to 90 emu/g of manganese-strontium (Mn—Sr) material or manganese-magnesium (Mn—Mg) material is preferable. In terms of ensuring the image density, highly magnetized materials such as iron powder (100 emu/g or more) and magnetite (75 emu/g to 120 emu/g) are preferable. In terms of capability of weakening the abutting to a photoconductor on which surface the toner is standing and in terms that it is advantageous in obtaining high-quality images, weakly magnetized materials such as copper-zinc (Cu—Zn) materials (30 emu/g to 80 emu/g) are preferable. These may be used alone, or in combination.

A particle diameter of the core is preferably 10 μm to 200 μm, and more preferably 40 μm to 100 μm based on the average particle diameter (mass average particle diameter ($D_{50}$)).

When the average particle diameter (mass average particle diameter ($D_{50}$) is smaller than 10 μm, it may sometimes cause carrier scattering due to an increase in the amount of fine particles in the carrier particle distribution and the reduced magnetization per particle. When it is greater than 200 μm, toner scattering may occur, and in the case of a full-color image with a large area of solid part, in particular, the reproductivity of the solid part may sometimes degrade.

A material of the resin layer is not particularly limited and may be appropriately selected from those known in the art depending on the purpose. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidenefluoride and acrylic monomer, copolymers of vinylidenefluoride and vinylfluoride, fluoroterpolymers such as terpolymers of tetrafluoroethylene, vinylidenefluoride and non-fluoride monomers, and silicone resins. These may be used alone, or in combination.

Examples of the amino resins include urea-formaldehyde resins, melamine resins, benzoguanamine resins, urea resins, polyamide resins, and epoxy resins. Examples of the polyvinyl resins include acrylic resins, polymethylmethacrylate resins, polyacrylonitirile resins, polyvinyl acetate resins, polyvinyl alcohol resins, polyvinyl butyral resins. Examples of the polystyrene resins include polystyrene resins and styrene-acrylic copolymer resins. Examples of the halogenated olefin resins include polyvinyl chloride resins. Examples of the polyester resins include polyethyleneterephthalate resins and polybutyleneterephthalate resins.

The resin layer may contain conductive powders as necessary. Examples of the conductive powders include metal powders, carbon black, titanium oxide, tin oxide, and zinc oxide. The conductive powders preferably have an average particle diameter of 1 μm or less. When the average particle diameter exceeds 1 μm, electric resistances may be hard to control.

The resin layer can be formed by a method, for example, in which the silicone resin and the like are dissolved in a solvent to prepare an application solution, thereafter this application solution is uniformly applied by the known application method onto the surface of the core, dried, and then baked. Examples of the application methods include dipping, spraying, and brush coating.

The solvent is not particularly limited and may be appropriately selected depending on the intended purpose. Examples thereof include toluene, xylene, methyl ethyl ketone, methyl isobutyl ketone, cellosolve and butyl acetate.

The baking is not particularly limited, and may be external heating or internal heating. Examples of the baking include methods of using a fixed-type electric furnace, a flow-type electric furnace, a rotary-type electric furnace, or a burner furnace, and a method of using microwaves.

The amount of the resin layer in the carrier is preferably 0.01% by mass to 5.0% by mass. When the amount is less than 0.01% by mass, the resin layer may not be uniformly formed on the surface of the core. When the amount is more than 5.0% by mass, the resin layer is formed excessively thick to cause granulation among carrier particles, and uniform carrier particles may not be obtained.

In the case where the developer is a two component developer, the amount of the carrier in the two component developer is not particularly limited and may be appropriately selected depending on the purpose. For example, it is preferably 90% by mass to 98% by mass, more preferably 93% by mass to 97% by mass.

The mixing ratio of the toner and the carrier in a tow-component developer is generally 1 part by mass to 10.0 parts by mass of the toner with respect to 100 parts by mass of the carrier.

The developer of the present invention contains the toner of the present invention, so that excellent low temperature fixability, anti-hot offset property can be satisfied and excellent high definition image can be formed.

The developer of the present invention is suitably used in an image formation by those known electrophotographic methods, such as a two-component developing method, and particularly suitably used in a process cartridge, image forming apparatus and image forming method, which will be explained hereinbelow.

(Process Cartridge)

The process cartridge to be used in the present invention includes at least a latent electrostatic image bearing member configured to bear a latent electrostatic image, and a developing unit configured to develop a latent electrostatic image formed on the latent electrostatic image bearing member using a toner so as to form a visible image, and further includes other unit appropriately selected as necessary.

The developing unit includes at least a developer container containing therein the toner or the developer of the present invention, and a developer carrier configured to carry and deliver the toner or developer contained in the developer container, and may further include a layer thickness regulation member configured to regulate a layer thickness of toner to be carried.

The process cartridge can be mounted detachably onto various electrophotographic image forming apparatuses, and preferably may be detachably mounted onto the image forming apparatus used in the present invention as described below.

Figure 2:
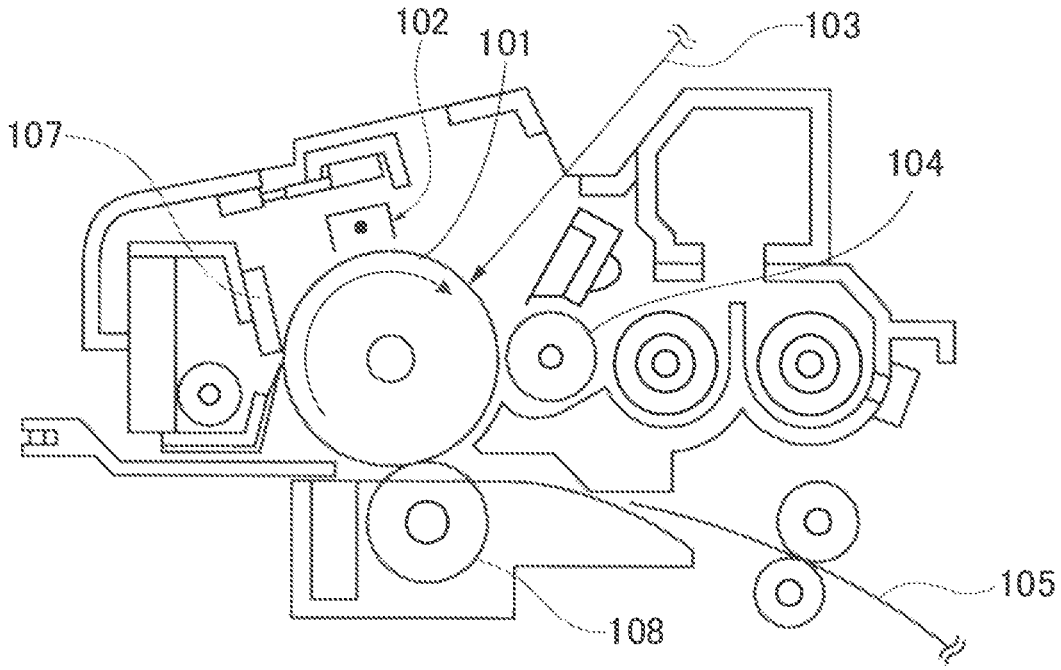
FIG. 2 shows a schematic configuration of an example of a process cartridge used in the present invention.

Here, the process cartridge, for example, as shown in FIG. 2, contains therein a photoconductor 101, and further contains at least one of a charging unit 102, a developing unit 104, a transferring unit 108, a cleaning unit 107, and a charge eliminating unit (not shown), and is an apparatus (component) which can be mounted detachably onto an image forming apparatus.

The image forming process by the process cartridge shown in FIG. 2 is described. While the photoconductor 101 is rotated in a direction indicated by an arrow in the drawing, a latent electrostatic image corresponding to an exposure image is formed on the surface thereof by a charging unit 102 and exposure 103 provided by an exposure unit (not shown). The latent electrostatic image is developed with a toner by the developing unit 104, and the developed toner image is transferred to a recording medium 105 by means of the transferring unit 108, and printed out. Subsequently, the photoconductor surface on which the image has been transferred is cleaned by the cleaning unit 107, and electrical charges are removed by a charge eliminating unit (not shown). Then, these operations will be repeated.

(Image Forming Apparatus and Image Forming Method)

The image forming apparatus used in the present invention contains at least an latent electrostatic image bearing member, a latent electrostatic image forming unit, a developing unit, a transferring unit and a fixing unit, and further contains other units such as a charge eliminating unit, a cleaning unit, a recycling unit and a control unit, which are optionally selected as necessary.

The image forming method of the present invention contains at least a latent electrostatic image forming step, a developing step, a transferring step and a fixing step, and further contains other steps such as a charge eliminating step, a cleaning step, a recycling step and a controlling step, which are optionally selected as necessary.

The image forming method according to the present invention may be properly performed by the image forming apparatus used in the present invention. The latent electrostatic image forming step may be performed by the latent electrostatic image forming unit, the developing step may be performed by the developing unit, the transferring step may be performed by the transferring unit, and the fixing step may be performed by the fixing unit. The other steps may be performed by the other units.

For the image forming apparatus, a developing system in which different developing units for at least four developing colors are arranged in tandem is preferably used, wherein a linear velocity of the system is 500 mm/sec to 2,500 mm/sec, and a surface pressured of the fixing unit is 5 N/cm$^2$ to 90 N/cm$^2$. Thus, low temperature fixability at high speed printing can be achieved, so that an image having solid fixing strength can be obtained even when the heat amount for fixation is not sufficiently provided.

—Latent Electrostatic Image Forming Step and Latent Electrostatic Image Forming Unit—

The latent electrostatic image forming step is a step of forming a latent electrostatic image on a latent electrostatic image bearing member.

The material, shape, structure, size, and several features of the latent electrostatic image bearing member (hereinafter also referred to as "photoconductor") are not particularly limited and may be appropriately selected from those known in the art. As the shape a drum shaped is preferable. For the material constituting the latent electrostatic image bearing member, inorganic photoconductive materials such as amorphous silicon and selenium, and organic photoconductive materials such as polysilane and phthalopolymethine are preferable. Among these, amorphous silicon is preferable in terms of its long life.

As the amorphous silicon photoconductor, employed is a photoconductor that is manufactured, for example, by heating a support at 50° C. to 400° C. to include a photoconductive layer made of a-Si (hereinafter, also referred to as "a-Si photoconductor) by film deposition methods such as vacuum deposition, sputtering, ion-plating, heat CVD method, optical CVD method, and plasma CVD method. Among these methods, preferred is the plasma CVD method, that is, the method in which a raw material gas is decomposed with a direct current, high frequency, or microwave glow discharge, and an a-Si deposition film is formed on a support.

The formation of the latent electrostatic image is achieved by, for example, exposing the latent electrostatic image bearing member imagewisel after uniformly charging its entire surface. This step is performed by means of the latent electrostatic image forming unit.

The latent electrostatic image forming unit contains at least a charging unit configured to uniformly charge the surface of the latent electrostatic image bearing member, and an exposing unit configured to expose imagewise the surface of the latent electrostatic image bearing member.

The charging step is achieved by, for example, applying voltage to the surface of the latent electrostatic image bearing member by means of the charging unit.

The charging unit is not particularly limited and may be appropriately selected depending on the intended purpose. Examples thereof include known contact-chargers equipped with a conductive or semiconductive roller, blush, film or rubber blade, and known non-contact-chargers utilizing corona discharge such as corotron or scorotoron.

The charging member may be configured to be in any form, such as a magnetic brush or a fur brush, in addition to a roller. These charging members may be selected depending on the specification or form of electrophotographic apparatuses. In the case of using a magnetic brush, the magnetic brush uses various ferrite particles, for example, Zn—Cu ferrites as a charging member, and is constructed of a non-magnetic conductive sleeve for supporting these ferrite particles, and a magnet roll contained therein. Alternatively, in the case of using a brush, a fur having been processed to be conductive with carbon, copper sulfide, a metal, or a metal oxide is used as material of a fur brush, and this fur is wound or attached to a metal or other cores having been processed to be conductive, so as to be a charger.

Although the charging unit is not limited to the contact-charger, an image forming apparatus in which ozone generated from the charging unit is reduced can be obtained, so that a contact-charger is preferably used.

The exposing step is achieved by, for example, exposing the surface of the latent electrostatic image bearing member imagewise by means of an exposing unit.

The exposing unit is not particularly limited as long as it is capable of performing imagewise exposure on the surface of the charged latent electrostatic image bearing member by means of the charging unit, and may be appropriately selected depending on the intended use. Examples thereof include various exposing units, such as optical copy devices, rod-lens-eye devices, optical laser devices, and optical liquid crystal shatter devices.

Note in the present invention that a backlight system may be employed for exposure, where imagewise exposure is performed from the back side of the latent electrostatic image bearing member.

—Developing Step and Developing Unit—

The developing step is a step of developing a latent electrostatic image using the toner or developer of the present invention to form a visible image.

Formation of a visible image may be performed by, for example, developing a latent electrostatic image with the use of the toner or the developer of the present invention, and may be performed with the developing unit.

The developing unit is not particularly limited as long as an image can be developed with the use of the toner or the developer, and may be appropriately selected from those known in the art. For example, the developing units that include at least a developing unit capable of containing therein the toner or developer of the present invention, and of applying the toner or the developer to a latent electrostatic image in a contact or non-contact manner are preferred.

The developing unit may be of drying developing type or wet developing type, or may be a single-color developing unit or a multi-color developing unit. The developing units include, for example, preferably the ones that have stirrer that stirs in friction the toner or the developer to be charged, and a ratable magnet roller.

In the developing unit, for example, the toner and the carrier are mixed and stirred, the toner is charged due to friction in the process and held in the standing state on the surface of a magnet roller in rotation, thereby forming a magnetic brush. Since this magnet roller is disposed in the vicinity of the latent electrostatic image bearing member (photoconductor), a part of the toner that forms the magnetic brush formed on the surface of the magnet roller, is transferred to the surface of the latent electrostatic image bearing member (photoconductor) due to an electrical absorption. As a result, the latent electrostatic image is developed with the toner, and then a visible image is formed with the toner on the surface of the latent electrostatic image bearing member (photoconductor).

A developer contained in the developing unit is a developer containing the toner of the present invention, and the developer may be a one-component developer or a two-component developer. The toner contained in the developer is the toner of the present invention.

—Transferring Step and Transferring Unit—

The transferring step is a step of transferring a visible image to a recording medium. In a preferred aspect, the visible image is transferred to an intermediate transfer medium as a primary transfer, the visible image is then transferred on the recording medium as a secondary transfer. More preferably, using a toner of two or more colors, preferably using a full color toner, the visible image is transferred to the intermediate transfer member to form a multiple-transfer image as the primary transfer, and the multiple-transfer image is transferred to the recording medium as the secondary transfer.

The transferring step is performed by the transferring unit, for example, the visible image is transferred by charging the latent electrostatic image bearing member (photoconductor) using a transfer-charger. In a preferred aspect, the transferring unit contains a primary transferring unit configured to transfer the visible image to the intermediate transfer medium to form a multiple-transfer image, and a secondary transferring unit configured to transfer the multiple-transfer image to the recording medium.

The intermediate transfer member is not particularly limited and may be appropriately selected from those known in the art. For example, a transferring belt is preferable.

The static friction coefficient of the intermediate transfer medium is preferably 0.1 to 0.6, and more preferably 0.3 to 0.5. The volume resistance of the intermediate transfer medium is preferably several Ω·cm to $10^3$ Ω·cm. By controlling the volume resistance from several Ω·cm to $10^3$ Ω·cm, charging of the intermediate transfer medium itself is prevented. It also prevents uneven transfer upon secondary transfer because the charge provided by a charge application unit does not easily remain on the intermediate transfer medium. In addition, transfer bias for the secondary transfer can be easily applied.

The materials for the intermediate transfer medium is not particularly limited and may be appropriately selected from those known in the art depending on the intended purpose; examples are as follows:

(1) Materials having a high Young's modulus (tension modulus) used as a single layer belt, which includes polycarbonates (PC), polyvinylidene fluoride (PVDF), polyalkylene terephthalate (PAT), blend materials of PC and PAT, blend materials of ethylene tetrafluoroethylene copolymer (ETFE) and PC, and blend materials of ETFE and PAT, thermosetting polyimides of carbon black dispersion, and the like. These single layer belts having high Young's moduli are small in their deformation against stress during image formation and are particularly advantageous in that mis-registration is not easily formed when forming a color image.

(2) A double or triple layer belt using the above-described belt having a high Young's modulus as a base layer, added with a surface layer or an intermediate layer around the peripheral side of the base layer. The double or triple layer belt has a capability to prevent transfer defect of a line image that is caused by the hardness of the single layer belt.

(3) A belt having a relatively low Young's modulus that includes a rubber or an elastomer. The belt has an advantage that there is almost no transfer defect of a line image due to its softness. Additionally, meandering of the belt can be prevented by making the width of the belt wider than driving and tension rollers and thereby using the elasticity of the edge portions that extend over the rollers. Therefore, it can reduce cost without the need for ribs and a device to prevent meandering.

Conventionally, for intermediate transfer belts fluorine resins, polycarbonates, polyimides, and the like have been used, but in the recent years, elastic belts in which elastic members are used in all layers or a part thereof. There are the following issues on transfer of color images using a resin belt.

Color images are typically formed by four colors toners. In one color image, toner layer(s) consisting of one layer to four layers are formed. Toner layers are pressurized as they pass the primary transfer in which the layers are transferred from the photoconductor to the intermediate transfer belt and the secondary transfer in which the toner layers are transferred from the intermediate transfer belt to the sheet, which increases the cohesive force among toner particles. As the cohesive force increases, phenomena such as dropouts of letters and dropouts of edges of solid images are likely to occur. Since resin belts are excessively hard and not deformed according to the toner layers, they tend to compress the toner layers and therefore dropout of letters are likely to occur.

Recently, the demand for printing full color images on various types of paper such as Japanese paper and paper having a rough surface is increasing. However, sheets of paper having low smoothness tend to form air gaps between the toner and the sheet upon transfer and thus leading to defective transfers. When the transfer pressure of secondary transfer section is raised in order to increase contact, the cohesive force of the toner layers will be higher, which will result in dropout of letters as described above.

Elastic belts are used for the following purpose. Elastic belts deform according to the toner layers and the roughness of the sheet having low smoothness at the transfer section. In other words, since the elastic belts deform to comply with local irregularity, a good contact is achieved without increasing the transfer pressure against the toner layers excessively so that it is possible to obtain transferred images having excellent uniformity without any dropout of letters even on sheets of paper having low flatness.

Examples of the resin of the elastic belts include, but not limited thereto, polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymers, styrene-vinyl chloride copolymers, styrene-vinyl acetate copolymers, styrene-maleic acid copolymers, styrene-acrylate copolymers (styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (styrene-methyl methacrylate copolymers, styrene-ethyl methacrylate copolymers, and styrene-phenyl methacrylate copolymers), styrene-α-chloromethyl acrylate copolymers, styrene-acrylonitrile acrylate copolymers, methyl methacrylate resins, butyl methacrylate resins, ethyl acrylate resins, butyl acrylate resins, modified acrylic resins (silicone-modified acrylic resins, vinyl chloride resin-modified acrylic resins, and acrylic urethane resins), vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene, polypropylene, polybutadiene, polyvinylidene chloride, ionomer resins, polyurethane resins, silicone resins, ketone resins, ethylene-ethylacrylate copolymers, xylene resins and polyvinylbutylal resins, polyamide resins, and modified polyphenylene oxide resins. These may be used alone or in combination.

The rubber and elastomer of the elastic materials are not particularly limited and may be appropriately selected depending on the intended purpose. Examples thereof include butyl rubber, fluorine rubber, acrylic rubber, ethylene propylene rubber (EPDM), acrylonitrilebutadiene rubber (NBR), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosufonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers such as polystyrene elastomers, polyolefin elastomers, polyvinyl chloride elastomers, polyurethane elastomers, polyamide elastomers, polyurea elastomers, polyester elastomers and fluorine resin elastomers. These may be used alone or in combination.

A conductive agent for adjusting resistance is not particularly limited and may be appropriately selected depending on the intended purpose. Examples thereof include metal powders such as carbon black, graphite, aluminum and nickel; conductive metal oxides such as tin oxide, titanium oxide, antimony oxide, indium oxide, potassium titanate, antimony tin oxide (ATO), and indium tin oxide (ITO). The insulating fine particles such as barium sulfate, magnesium silicate, and calcium carbonate may be coated with conductive metal oxides.

Materials of the surface layer are required to prevent contamination of the photoconductor by the elastic material and to reduce the surface friction of the transfer belt so that toner adhesion is lessened and the cleanability and secondary transfer property are increased. For example, one or more of polyurethane, polyester, epoxy resins, and the like is used, and powders or particles of a material that reduces surface energy and enhances lubrication such as fluorine resin, fluorine compound, carbon fluoride, titanium dioxide, silicon carbide, or the like can be dispersed and used. One or more lubricant materials may be used, alternatively, powders or particles of different sizes may be employed. In addition, it is possible to use a material such as fluorine rubber that is treated with heat so that a fluorine-rich layer is formed on the surface and the surface energy is reduced.

A method for producing the elastic belt is not particularly limited and may be appropriately selected depending on the intended purpose. Examples thereof include a centrifugal forming method in which material is poured into a rotating cylindrical mold to form a belt; a spray coating method in which a liquid coating solution is sprayed to form a film; a dipping method in which a cylindrical mold is dipped into a solution of material and then pulled out; an injection mold method in which material is injected into inner and outer molds; a method in which a compound is applied onto a cylindrical mold and the compound is vulcanized and ground. Generally, a plurality of the methods are used in combination for producing the elastic belt.

A method for preventing the elastic belt from elongating is not particularly limited and may be appropriately selected depending on the intended purpose. Examples thereof include a method in which a rubber layer is formed on a core layer which is less stretchable; and a method in which materials that prevent elongation are added to a core layer.

The material for forming the core layer, which prevents elongation is not particularly limited and may be appropriately selected depending on the intended purpose. Examples thereof include natural fibers such as cotton, and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenol fibers; inorganic fibers such as carbon fibers, glass fibers, and boron fibers; metal fibers such as iron fibers, and copper fibers. Additionally, these materials that are in a form of a woven cloth or thread may also be used.

The thread may be one filament or twisted filaments, single twist yarn, plied yarn, two folded yarn, those twisted (plie), or those made by any method. Alternatively, a fiber made of one selected from the above-described materials may be blended. A thread which is subjected to proper conductive treatment may be used. On the other hand, the woven cloth by means of any texture such as tricot weave can be used. A union fabric may be possibly used and can be naturally subjected to conductive treatment.

The method for forming the core layer is not particularly limited and may be appropriately selected depending on the intended purpose. Examples thereof include a method in which a woven cloth that is woven in a cylindrical shape is placed on a mold or the like and a coating layer is formed on top of it; a method in which a woven cloth that is woven in a cylindrical shape is dipped in a liquid rubber or the like so that coating layer(s) are formed on one side or on both sides of the core layer; and a method in which a thread is twisted helically around a mold or the like with an arbitrary pitch, and then a coating layer is formed thereon.

As the coated layer comes to thicker, elongation and contraction of the surface comes to more significant, depending on the hardness of the coated layer, and the surface layer is susceptible to cracks, causing significant elongation and contraction of images, therefore, excessive thickness, such as approximately 1 mm or more is undesirable.

The transferring unit, i.e. the primary transferring unit and the secondary transferring unit, preferably has at least a transfer device that is configured to charge so as to separate the visible image formed on the latent electrostatic image bearing member and transfer the visible image onto a recording medium. One transfer device or two transfer devices may be used. Examples thereof include corona transfer devices utilizing corona discharge, transfer belts, transfer rollers, pressure-transfer rollers, and adhesion-transfer devices.

The recording medium is typically a plain paper, but is not particularly limited as long as it is a recording medium on which an unfixed image which has been developed can be transferred, and may be appropriately selected depending on the intended purpose. A polyethylene terephthalate (PET) base for overhead projector (OHP) may be used.

The fixing step is a step of fixing a visible image transferred on a recording medium using a fixing unit, and the fixing step may be performed every time each color toner is transferred onto the recording medium or at a time using superimposed individual color toners.

The fixing device is not particularly limited and may be appropriately selected depending on the intended purpose. Heat-pressure units known in the art are preferably used. Examples of the heat-pressure units include a combination of a heat roller and a pressure roller, and a combination of a heat roller, a pressure roller and an endless belt.

The heating temperature in the heat-pressure unit is preferably 80° C. to 200° C.

In the present invention, for example, an optical fixing device known in the art may be used in the fixing step and the fixing unit or instead of the fixing unit.

The charge elimination step is a step in which the charge is eliminated by applying a charge-eliminating bias to the latent electrostatic image bearing member, and it can be suitably performed by means of a charge-eliminating unit.

The charge-eliminating unit is not particularly limited as long as it can apply a charge-eliminating bias to the latent electrostatic image bearing member, and may be appropriately selected from those known in the art. For example, charge-eliminating lamps are preferable.

The cleaning step is a step of removing a residual electrophotographic toner remaining on the latent electrostatic image bearing member, and the cleaning can be preferably performed using a cleaning unit.

The cleaning unit is not particularly limited as long as it removes a residual electrophotographic toner remaining on the latent electrostatic image bearing member, and may be appropriately selected from those known in the art. Examples thereof include magnetic brush cleaners, electrostatic brush cleaners, magnetic roller cleaners, blade cleaners, brush cleaners, and web cleaners.

The recycling step is a step of recycling a removed toner in the cleaning step to the developing step, and the recycling step can be suitably performed by means of a recycling unit.

The recycling unit is not particularly limited and may be appropriately selected depending on the intended purpose. Examples thereof include conventional conveying or transporting units.

The control step is a step of controlling each of the above-mentioned steps, and is preferably performed by a control unit.

The control unit is not particularly limited as long as it can control operation of the above-mentioned units, and may be appropriately selected depending on the intended purpose. Examples thereof include instruments such as sequencers and computers.

One embodiment of the image forming method of the present invention by means of the image forming apparatus used in the present invention will be described with reference to FIG. 3. An image forming apparatus 100 shown in FIG. 3 contains a photoconductor drum 10 (hereinafter referred to as "photoconductor 10") as the latent electrostatic image bearing member, a charging roller 20 as the charging unit, an exposure device as the exposing unit configured to provide exposure 30, a developing device 40 as the developing unit, an intermediate transfer medium 50, a cleaning device 60 as the cleaning unit having a cleaning blade, and a charge eliminating lamp 70 as the charge eliminating unit.

An intermediate transfer medium 50 is an endless belt, and is so designed that it stretches around three rollers 51 disposed inside thereof and rotates in the direction shown by the arrow by means of rollers 51. One or more of three rollers 51 also functions as a transfer bias roller capable of applying a certain transfer bias (primary bias) to the intermediate transfer medium 50. A cleaning blade 90 is provided adjacent to the intermediate transfer medium 50. There is provided a transferring roller 80 facing to the intermediate transfer medium 50 as the transferring unit capable of applying a transfer bias so as to transfer a developed image (toner image) to a transfer sheet 95 as a recording medium (secondary transferring). Moreover, there is provided a corona charger 58 around the intermediate transfer medium 50 for applying charges to the toner image transferred on the intermediate transfer medium 50. The corona charger 58 is arranged between the region where the photoconductor 10 contacts with the intermediate transfer medium 50 and the region where the intermediate transfer medium 50 contacts with the transfer sheet 95, in the rotational direction of the intermediate transfer medium 50.

A developing device 40 contains a developing belt 41 as a developer bearing member, a black developing unit 45K, a yellow developing unit 45Y, a magenta developing unit 45M and a cyan developing unit 45C, these developing units being positioned around the developing belt 41. The black developing unit 45K contains a developer container 42K, a developer supplying roller 43K, and a developing roller 44K. The yellow developing unit 45Y contains a developer container 42Y, a developer supplying roller 43Y, and a developing roller 44Y. The magenta developing unit 45M contains a developer container 42M, a developer supplying roller 43M, and a developing roller 44M. The cyan developing unit 45C contains a developer container 42C, a developer supplying roller 43C, and a developing roller 44C. The developing belt 41 is an endless belt stretched around a plurality of belt rollers so as to be rotatable. A part of the developing belt 41 is in contact with the photoconductor 10.

Figure 3:
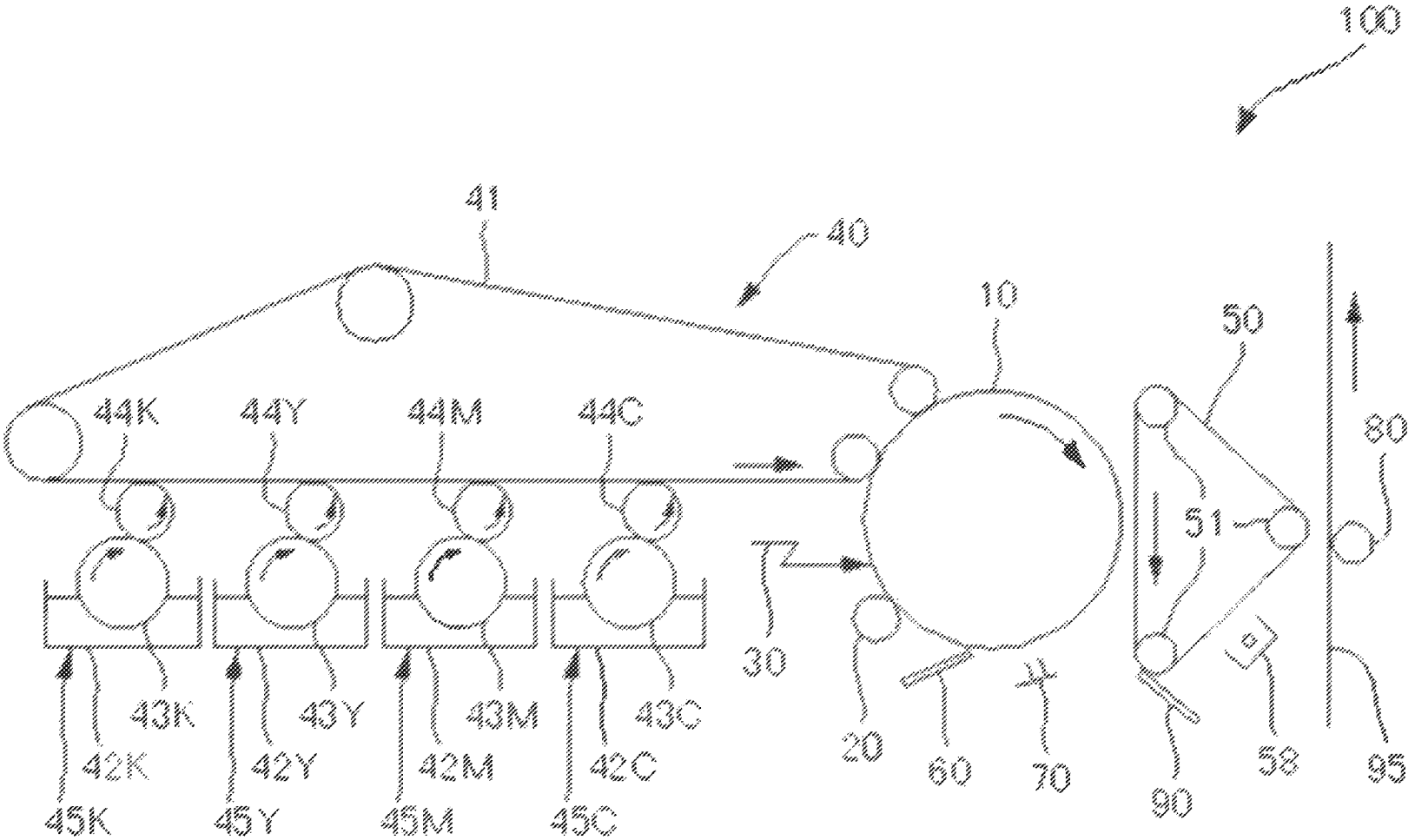
FIG. 3 shows a schematic configuration of an example of an image forming apparatus used in the present invention.

In image forming apparatus 100 shown in FIG. 3, the photoconductor drum 10 is uniformly charged by means of, for example, the charging roller 20. The exposure device then exposes imagewise on the photoconductor drum 10 so as to form a latent electrostatic image. The latent electrostatic image formed on the photoconductor drum 10 is supplied with toner from the developing device 40 to form a visible image (toner image). The roller 51 applies a bias to the toner image to transfer the visible image (toner image) onto the intermediate transfer medium 50 (primary transferring), and further applies a bias to transfer the toner image from the intermediate transfer medium 50 to the transfer sheet 95 (secondary transferring). In this way a transferred image is formed on the transfer sheet 95. Thereafter, toner remained on the photoconductor drum 10 is removed by means of the cleaning device 60, and charge of the photoconductor drum 10 are removed by means of a charge eliminating lamp 70 on a temporary basis.

Figure 4:
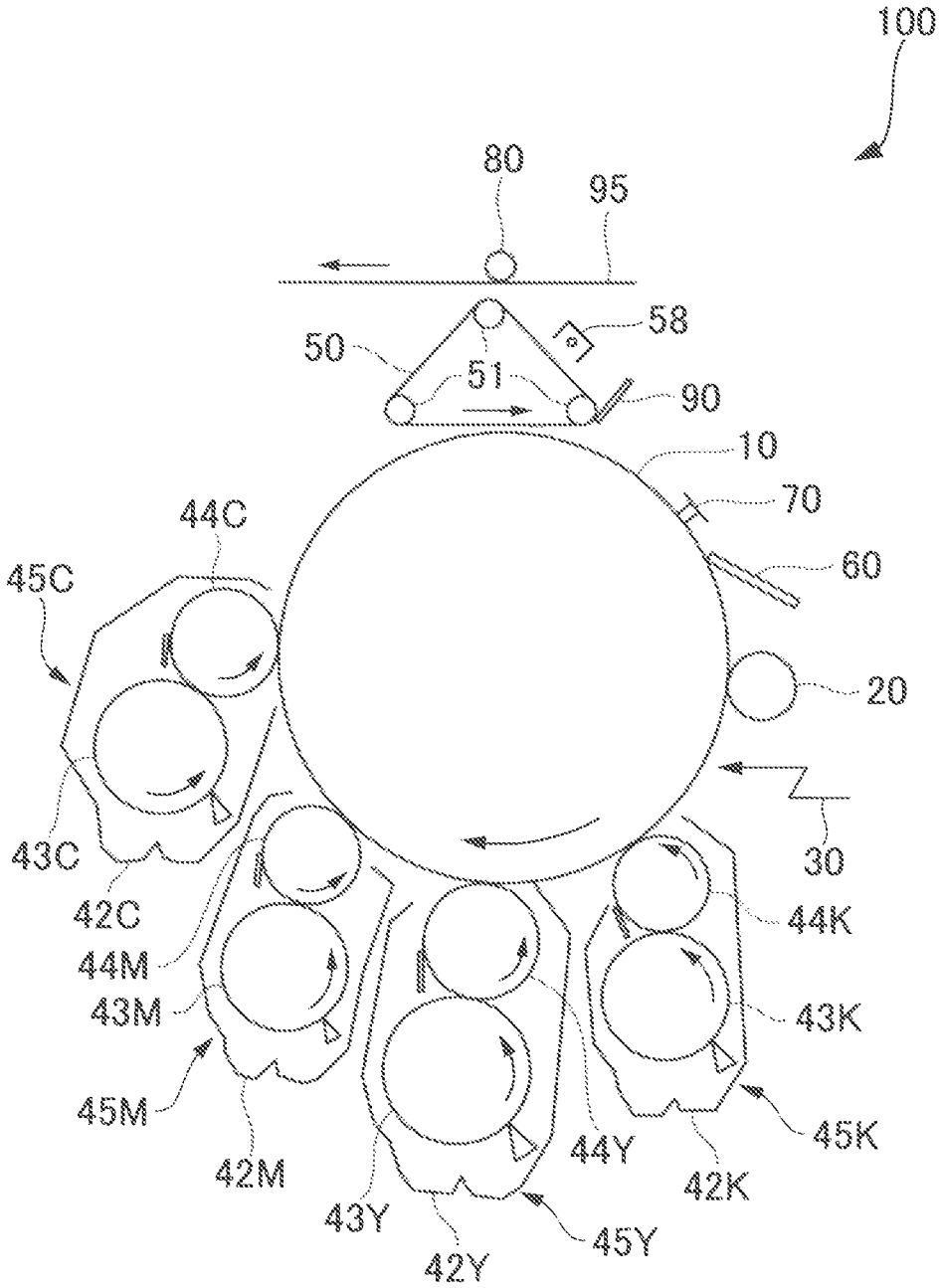
FIG. 4 shows a schematic configuration of an example of another image forming apparatus used in the present invention.

Another embodiment of the image forming method of the present invention by means of the image forming apparatus used in the present invention will be described with reference to FIG. 4. The image forming apparatus 100 shown in FIG. 4 has the same configuration and working effects to those of the image forming apparatus 100 shown in FIG. 3 except that this image forming apparatus 100 does not contain the developing belt 41 and that the black developing unit 45K, yellow developing unit 45Y, magenta developing unit 45M and cyan developing unit 45C are disposed so as to face the photoconductor 10. Note in FIG. 4 that members identical to those in FIG. 3 are denoted by the same reference numerals.

Figure 5:
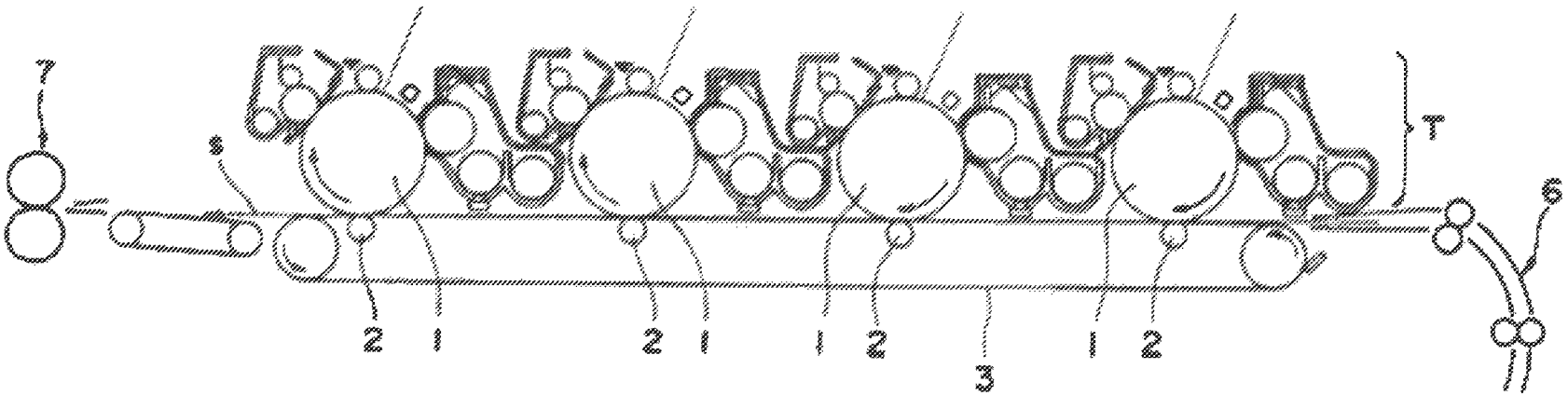
FIG. 5 shows a schematic configuration of an example of still another image forming apparatus used in the present invention.
Figure 6:
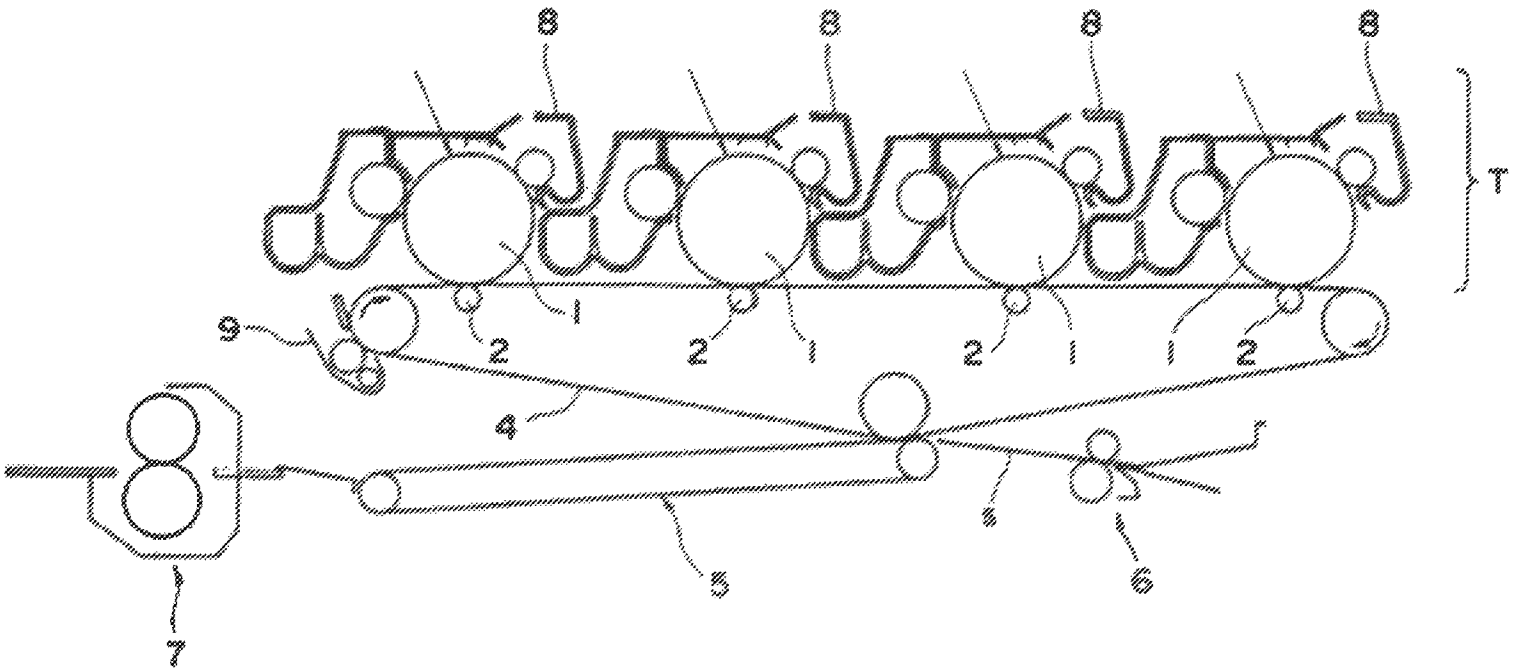
FIG. 6 shows a schematic configuration of an example of further still another image forming apparatus used in the present invention.

There are two types of tandem image forming apparatus: a direct transfer type and an indirect transfer type: in the direct transfer type, visible images formed on each of photoconductors 1 are transferred sequentially by a transferring unit 2 onto a recording medium S which is transported by a transfer-conveying belt 3, as shown in FIG. 5; and in the indirect transfer type, visible images on each photoconductor 1 are temporarily transferred sequentially by a primary transferring unit 2 to the surface of an intermediate transfer medium 4 and then all the images on the intermediate transfer medium 4 are transferred together onto the recording medium S at a time by a secondary transferring unit 5 as shown in FIG. 6. Note that in FIG. 6, as a secondary transferring unit 5, a transfer-conveying belt is used, but it may be in a roller shape.

The direct transfer type, as compared to the indirect transfer type, has a drawback of glowing in size in a transporting direction of the recording medium because a paper feeding unit 6 must be placed on the upper side of a tandem image forming section T where the photoconductors 1 are aligned, whereas a fixing unit 7 must be placed on the lower side of the apparatus. In contrast, the indirect transfer type is advantageous in that the secondary transfer site may be installed relatively freely, and the paper feeding unit 6 and the fixing unit 7 may be placed together with the tandem image forming section T, making it possible to be downsized.

To avoid size-glowing in the transporting direction of the recording medium in the direct transfer type, the fixing unit 7 must be placed close to the tandem image forming section T. However, it is impossible to place the fixing unit 7 in a way that gives enough space for the recording medium S to bend, and the fixing unit 7 may easily affect the image forming on the upper side by the impact generated from the leading end of the recording medium S as it approaches the fixing unit 7 (this becomes conspicuous with a thick sheet), or by the difference between the transporting speed of the recording medium when it passes through the fixing unit 7 and the transporting speed of the recording medium when it is transported by the transfer-conveying belt. In contrast, the indirect transfer type allows the fixing unit 7 to be placed in a way that gives recording medium S an enough space to bend and the fixing unit 7 has almost no effect on the image formation.

For above reasons, the indirect transfer type of the tandem image forming apparatus is particularly interested recently.

This type of color image forming apparatus as shown in FIG. 6, prepares for the next image formation by removing a residual toner remaining on the photoconductors 1 by photoconductor cleaning units 8 to clean the surface of the photoconductors 1 after the primary transfer. It also prepares for the next image formation by removing a residual toner remaining on the intermediate transfer member 4 by a cleaning unit for intermediate transfer member 9 to clean the surface of the intermediate transfer member 4 after the secondary transfer.

Figure 7:
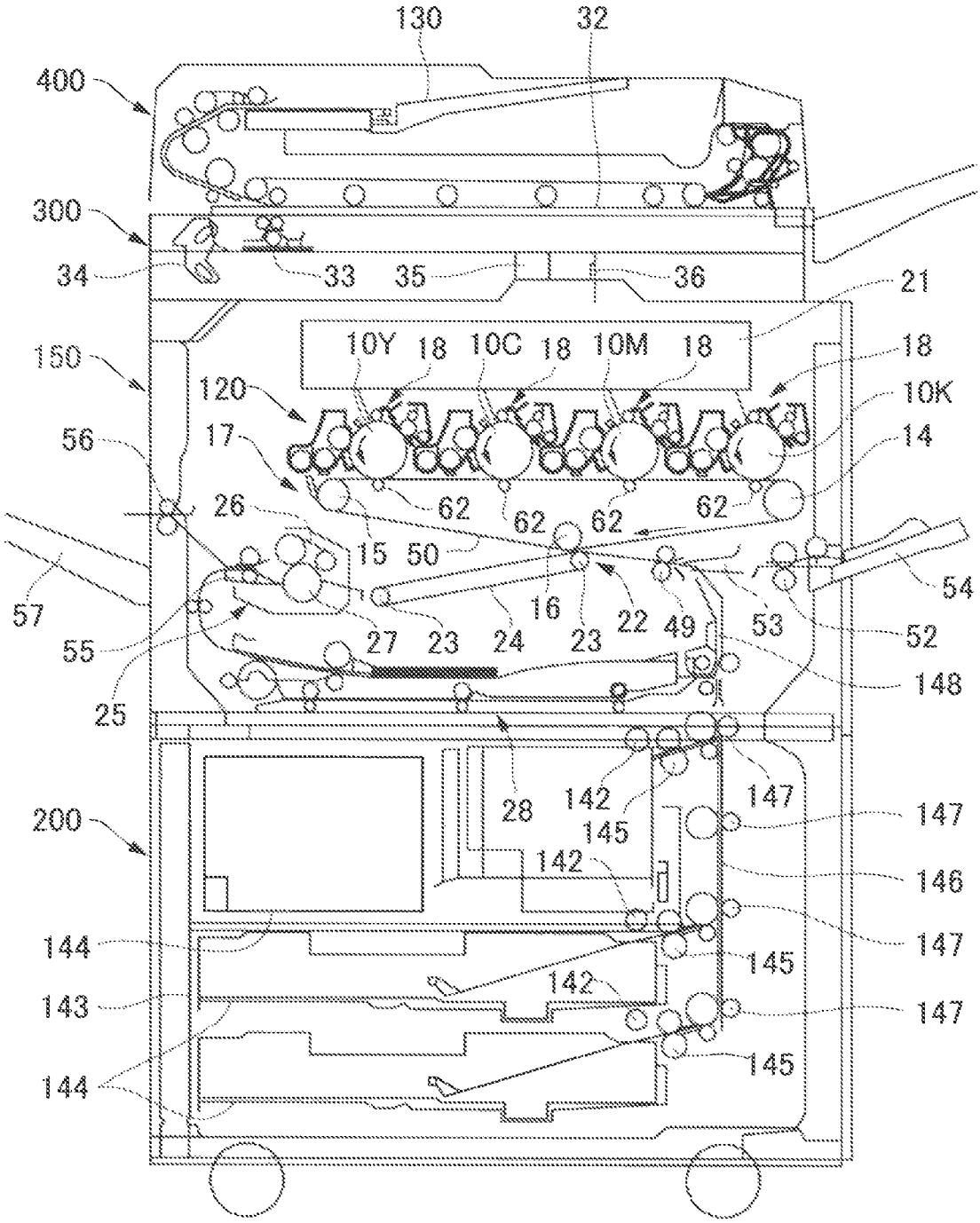
FIG. 7 shows a schematic configuration of an example of a tandem image forming apparatus used in the present invention.

Image forming apparatus shown in FIG. 7 is a tandem color image forming apparatus. The tandem image forming apparatus contains a copy machine main body 150, feeder table 200, scanner 300, and automatic document feeder (ADF) 400.

The copy machine main body 150 has an endless-belt intermediate transfer medium 50 in the center. The intermediate transfer medium 50 is stretched around support rollers 14, 15 and 16 and is configured to be rotatable in a clockwise direction in FIG. 7. A cleaning device for intermediate transfer medium 17 configured to remove toner particles remained on the intermediate transfer medium 50 is provided in the vicinity of the support roller 15. On the intermediate transfer medium 50 stretched around the support rollers 14 and 15, four color image forming units 18—yellow, cyan, magenta, and black—are aligned along the conveying direction so as to face the intermediate transfer medium 50, which constitutes a tandem developing unit 120. An exposing unit 21 is arranged adjacent to the tandem developing unit 120. A secondary transferring unit 22 is arranged across the intermediate transfer medium 50 from the tandem developing unit 120. The secondary transferring unit 22 contains a secondary transferring belt 24, which is an endless belt and stretched around a pair of rollers 23. A transfer sheet which is conveyed on the secondary transferring belt 24 is allowed to be contacted with the intermediate transfer medium 50. An image fixing unit 25 is arranged in the vicinity of the secondary transferring unit 22. The image fixing unit 25 contains a fixing belt 26 which is an endless belt, and a pressurizing roller 27 which is pressed by the fixing belt 26.

In the tandem image forming apparatus, a sheet reverser 28 is arranged adjacent to both the secondary transferring unit 22 and image fixing unit 25. A sheet reverser 28 turns over a transfer sheet to form images on the both sides of the transfer sheet.

Next, full-color image formation (color copying) using a tandem developing unit 120 will be described. At first, a source document is placed on a document tray 130 of an automatic document feeder 400. Alternatively, the automatic document feeder 400 is opened, the source document is placed on a contact glass 32 of a scanner 300, and the automatic document feeder 400 is closed.

When a start switch (not shown) is pushed, the source document placed on the automatic document feeder 400 is transferred onto the contact glass 32, and the scanner 300 is then driven to operate first and second carriages 33 and 34. In a case where the source document is originally placed on the contact glass 32, the scanner 300 is immediately driven after pushing of the start switch. Light is applied from a light source to the document by means of the first carriage 33, and light reflected from the document is further reflected by the mirror of the second carriage 34. The reflected light passes through the image-forming lens 35, and is received by the sensor 36 to read. In this way the color document (color image) is scanned, producing four types of color image information—black, yellow, magenta, and cyan.

Figure 8:
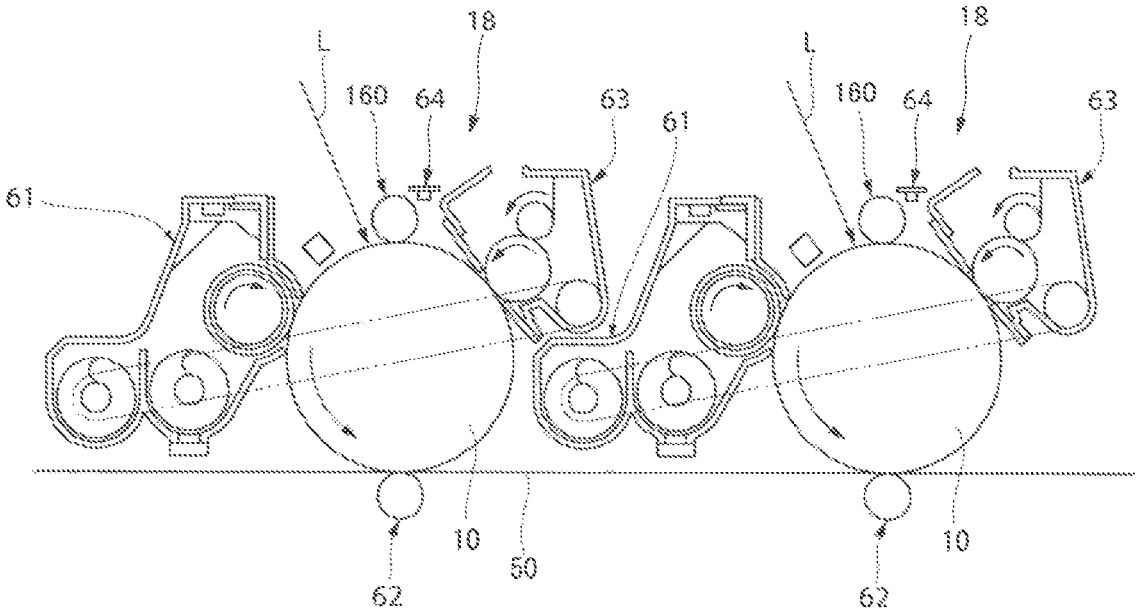
FIG. 8 is a partial enlarged view of FIG. 7.

Each image information of black, yellow, magenta, and cyan is transmitted to an image forming unit 18 (black image forming unit, yellow image forming unit, magenta image forming unit, or cyan image forming unit) of the tandem developing unit 120, and toner images of each color are formed in each image-forming unit 18. As shown in FIG. 8, each image-forming unit 18 (black image-forming unit, yellow image forming unit, magenta image forming unit, and cyan image forming unit) of the tandem developing unit 120 contains: a photoconductor 10 (photoconductor for black 10K, photoconductor for yellow 10Y, photoconductor for magenta 10M, or photoconductor for cyan 10C); a charging unit 160 configured to uniformly charge the photoconductor 10; an exposing unit configured to form a latent electrostatic image corresponding to the color image on the photoconductor by exposing imagewise (denoted by "L" in FIG. 8) on the basis of the corresponding color image information; a developing unit 61 configured to develop the latent electrostatic image using the corresponding color toner (black toner, yellow toner, magenta toner, or cyan toner) to form a toner image; a transfer charger 62 configured to transfer the toner image to an intermediate transfer medium 50, a cleaning device 63, and a charge eliminating device 64. Thus, images of one color (a black image, a yellow image, a magenta image, and a cyan image) can be formed based on the color image information. The black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred onto the intermediate transfer medium 50 which rotates by means of support rollers 14, 15 and 16 (primary transferring). These toner images are superimposed on the intermediate transfer medium 50 to form a composite color image (color transferred image).

Meanwhile, one of feed rollers 142 of the feed table 200 is selected and rotated, whereby sheets (recording paper) are ejected from one of multiple feed cassettes 144 in a paper bank 143 and are separated one by one by a separation roller 145. Thereafter, the sheets are fed to feed path 146, transferred by a transfer roller 147 into a feed path 148 inside the copying machine main body 150, and are bumped against the resist roller 49 to stop. Alternatively, one of the feed rollers 142 is rotated to eject sheets (recording paper) placed on a manual feed tray 54. The sheets are then separated one by one by means of the separation roller 145, fed into a manual feed path 53, and similarly, bumped against the resist roller 49 to stop. Note that the resist roller 49 is generally earthed, but it may be biased for removing paper dusts on the sheets. The resist roller 49 is rotated synchronously with the movement of the composite color image (color transferred image) on the intermediate transfer medium 50 to transfer the sheet (recording paper) into between the intermediate transfer medium 50 and the secondary transferring unit 22, and the composite color image (color transferred image) is transferred onto the sheet (recording paper) by means of the secondary transferring unit 22 (secondary transferring). In this way the color image is formed on the sheet (recording paper). Note that after image transferring, toner particles remained on the intermediate transfer medium 50 are cleaned by means of the cleaning device for intermediate transfer medium 17.

The sheet (recording paper), on which the transferred color image is formed, is conveyed by the secondary transferring unit 22 into the image fixing unit 25, where the composite color image (color transferred image) is fixed onto the sheet (recording paper) by heat and pressure. Thereafter, the sheet changes its direction by action of a switch hook 55, ejected by an ejecting roller 56, and stacked on an output tray 57. Alternatively, the sheet changes its direction by action of the switch hook 55, flipped over by means of the sheet reverser 28, and transferred back to the image transfer section for recording of another image on the other side. The sheet that bears images on both sides is then ejected by means of the ejecting roller 56, and is stacked on the output tray 57.

In the image forming method and image forming apparatus of the present invention, by using the toner of the present invention having suitable low temperature fixability, heat resistant storage property, developing stability, and responsiveness for high speed printing, a high quality image can be effectively formed.

EXAMPLES

The present invention will be described with reference to the following Examples, but these are not intended to be construed to limit the present invention. In Examples and Comparative Examples, all part(s) and percentage(s) (%) are expressed by mass-basis unless indicated otherwise.

Example 1

Production of Toner 1

—Synthesis of Organic Fine Particle Emulsion—

Into a reaction vessel equipped with a stirring rod and a thermometer, 683 parts of water, 11 parts of a sodium salt of a sulfate ester of methacrylic acid ethylene oxide adduct (ELEMINOL RS-30, manufactured by Sanyo Chemical Industries Ltd.), 166 parts of methacrylic acid, 70 parts of butyl acrylate, and 1 part of ammonium persulfate were loaded, and stirred at 2,800 rpm for 60 minutes to obtain a white emulsion. The emulsion was heated to a system 20 temperature of 75° C. and then reacted for 3 hours. Further, 30 parts of a 1% aqueous ammonium persulfate solution was mixed thereto, and the resulting mixture was matured at 75° C. for 4 hours to prepare an aqueous dispersion liquid of a vinyl resin (a copolymer of methacrylic acid-butyl acrylate-a sodium salt of a sulfate ester of methacrylic acid ethylene oxide adduct), Fine Particle Dispersion Liquid 1.

The volume average particle diameter of the obtained Fine Particle Dispersion Liquid 1 measured by a particle size distribution measurement device (LA-920, manufactured by HORIBA, Ltd.) was 180 nm. Further, a part of Fine Particle Dispersion Liquid 1 was dried to isolate a resin content. The resin content had a glass transition temperature (Tg) of 60° C., and a mass average molecular mass of 140,000.

—Preparation of Aqueous Phase—

990 parts of water, 83 parts of Fine Particle Dispersion Liquid 1, 37 parts of an aqueous solution of 48.3% dodecyldiphenyl ether sodium disulfonate (ELEMINOL MON-7, manufactured by Sanyo Chemical Industries Ltd.) and 90 parts of ethyl acetate were mixed and stirred to prepare an opaque white liquid. The resulting product was Aqueous Phase 1.

—Synthesis of Low-Molecular Polyester—

In a reaction vessel equipped with a cooling tube, an stirrer and a nitrogen inlet tube, 690 parts of a bisphenol A ethylene oxide (2 mol) adduct, 256 parts of terephthalic acid were reacted under atmospheric pressure at 230° C. for 6 hours. Subsequently, after having been reacted for 5 hours under reduced pressure of 10 mmHg to 15 mmHg, cooled to 160° C., 18 parts of phthalic anhydride was added to the resulting mixture in the reaction vessel, and reacted for 1 hour to synthesize Low-Molecular Polyester 1.

The obtained Low-Molecular Polyester 1 had a mass average molecular mass of 3,800, a glass transition temperature (Tg) of 460C, and an acid value of 10 mgKOH/g.

—Synthesis of Intermediate Polyester—

In a reaction vessel equipped with a cooling tube, a stirrer and a nitrogen inlet tube, 682 parts of a bisphenol A ethylene oxide (2 mol) adduct, 81 parts of a bisphenol A propylene oxide (2 mol) adduct, 283 parts of terephthalic acid, 22 parts of trimellitic anhydride and 2 parts of dibutyltin oxide were loaded, and reacted under atmospheric pressure at 230° C. for 7 hours. Subsequently, the resulting mixture was reacted for 5 hours under reduced pressure of 10 mmHg to 15 mmHg to synthesize Intermediate Polyester 1.

The obtained Intermediate Polyester 1 had a number average molecular mass of 2,200, a mass average molecular mass of 9,700, a glass transition temperature (Tg) of 54° C., an acid value of 0.5 mgKOH/g, and a hydroxyl value of 52 mgKOH/g.

Then, in a reaction vessel equipped with a cooling tube, an stirrer, and a nitrogen inlet tube, 410 parts of Intermediate Polyester 1, 89 parts of isophorone diisocyanate, and 500 pars of ethyl acetate were loaded, and reacted for 5 hours at 100° C. to synthesize Prepolymer 1.

The obtained Prepolymer 1 had 1.53% of a free isocyanate.

—Synthesis of Ketimine—

In a reaction vessel equipped with a stirring rod and a thermometer, 170 parts of isoholon diamine and 75 parts of methyl ethyl ketone were charged, and reacted for 4.5 hours at 50° C. to synthesize a Ketimine Compound 1. The obtained Ketimine Compound 1 had an amine value of 417.

—Preparation of Master Batch—

In a reaction vessel, 1,200 parts of water, 540 parts of carbon black (Printex 35, manufactured by Degussa Co., DBP oil absorption=42 ml/100 mg, pH=9.5), and 1,200 parts of polyester were added and mixed with HENSCHEL MIXER (manufactured by Mitsui Mining Co., Ltd.). The obtained mixture was kneaded for 1 hour at 110° C. using two rolls, and thereafter rolled and cooled, and milled with a pulverizer to obtain Master Batch 1.

—Preparation of Oil Phase—

In a reaction vessel equipped with a stirring rod and a thermometer, 378 parts of Low Molecular Polyester 1, 100 parts of paraffin wax (a glass transition temperature: 75° C.), and 947 parts of ethyl acetate were charged, and the temperature thereof was raised to 80° C. while stirring, kept for 5 hours as it was at 80° C., and thereafter cooled to 30° C. over 1 hour. Then, 500 parts of Master Batch 1 and 500 parts of ethyl acetate were added to the vessel, and mixed for one hour to produce Raw Material Solution 1.

Subsequently, 1,324 parts of Raw Material Solution 1 was transferred into a vessel, and carbon black and wax were dispersed using a bead mill (Ultraviscomill, manufactured by AIMEX CO., Ltd.) under conditions of a solution feed rate of 1 kg/hr, a disc peripheral speed of 6 m/sec, 0.5-mm zirconia beads packed at 80% by volume and six passes. Then, 1,324 parts of an ethyl acetate solution of 65% Low Molecular Polyester 1 was added using the bead mill under the above conditions except that six passes was change to two passes to obtain Pigment/Wax Dispersion Liquid 1.

The concentration of the solid content (at 130° C. for 30 minutes) of Pigment/Wax Dispersion Liquid 1 was 50%.

—Emulsification to Desolvation—

In a vessel, 749 parts of the Pigment/Wax dispersion Liquid 1, 115 parts of Prepolymer 1 and 2.9 parts of Ketimine Compound 1 were loaded and mixed using a TK homomixer (manufactured by Tokushu Kika Kogyo Co., Ltd.) at 5,000 rpm for two minutes. Subsequently, 1,200 parts of Aqueous Phase 1 was added to the vessel and mixed using the TK homomixer at a rotational frequency of 13,000 rpm for 25 minutes to obtain Emulsified Slurry 1.

In a vessel equipped with a stirrer and a thermometer, Emulsified Slurry 1 was added for desolvation at 30° C. for 8 hours, and then aged at 40° C. for 24 hours to obtain Dispersed Slurry 1.

—Washing and Drying—

After 100 parts of Dispersed Slurry 1 was filtrated under reduced pressure, washing and drying were performed as follows:

(i) One hundred (100) parts of ion-exchanged water was added to the filter cake, mixed using the TK homomixer at a rotational frequency of 12,000 rpm for 10 minutes and subsequently filtered.

(ii) One hundred (100) parts of an 10% aqueous sodium hydroxide solution was added to the filter cake of (i), mixed using the TK homomixer at a rotational frequency of 12,000 rpm for 30 minutes and subsequently filtered under reduced pressure.

(iii) One hundred (100) parts of a 10% hydrochloric acid solution was added to the filter cake of (ii), mixed using the TK homomixer at a rotational frequency of 12,000 rpm for 10 minutes and subsequently filtered.

(iv) Three hundred (300) parts of ion-exchanged water was added to the filter cake of (iii), mixed using the TK homomixer at a rotational frequency of 12,000 rpm for 10 minutes and subsequently filtered. These operations were performed twice to obtain Filter Cake 1.

The resulting Filter Cake 1 was dried by a circular wind dryer at 45° C. for 48 hours, and sieved with a mesh having 75 μm openings to obtain Toner Base Particles 1.

Subsequently, 1 part of hydrophobized silica having a diameter of 13 nm was mixed with 100 parts of Toner Base Particles 1 using a HENSCHEL MIXER to obtain Toner 1.

Example 2

Production of Toner 2

Toner 2 was produced in the same manner as in Example 1, except that the Organic Fine Particle Emulsion in Example 1 was changed as follows:

—Synthesis of Organic Fine Particle Emulsion—

Into a reaction vessel equipped with a stirring rod and a thermometer, 683 parts of water, 11 parts of a sodium salt of a sulfate ester of methacrylic acid ethylene oxide adduct (ELEMINOL RS-30, manufactured by Sanyo Chemical Industries Ltd.), 166 parts of methacrylic acid, 70 parts of butyl acrylate, and 1 part of ammonium persulfate were charged, and stirred at 3,800 rpm for 20 minutes to obtain a white emulsion. The emulsion was heated to a system temperature of 75° C. and then reacted for 3 hours. Further, 30 parts of a 1% aqueous ammonium persulfate solution was mixed thereto, and the resulting mixture was matured at 65° C. for 12 hours to produce an aqueous dispersion liquid of a vinyl resin (a copolymer of methacrylic acid-butyl acrylate-a sodium salt of a sulfate ester of methacrylic acid ethylene oxide adduct), Fine Particle Dispersion Liquid 2.

The volume average particle diameter of the obtained Fine Particle Dispersion Liquid 2 measured by a particle size distribution measurement device (LA-920, manufactured by HORIBA, Ltd.) was 310 nm. Further, a part of Fine Particle Dispersion Liquid 2 was dried to isolate a resin content. The resin content had a glass transition temperature (Tg) of 61° C., and a mass average molecular mass of 140,000.

Example 3

Production of Toner 3

Toner 3 was produced in the same manner as in Example 1, except that the Organic Fine Particle Emulsion and Low-Molecular Polyester in Example 1 were changed as follows:

—Synthesis of Organic Fine Particle Emulsion—

Into a reaction vessel equipped with a stirring rod and a thermometer, 683 parts of water, 11 parts of a sodium salt of a sulfate ester of methacrylic acid ethylene oxide adduct (ELEMINOL RS-30, manufactured by Sanyo Chemical Industries Ltd.), 166 parts of methacrylic acid, 70 parts of butyl acrylate, and 1 part of ammonium persulfate were charged, and stirred at 2,000 rpm for 20 minutes to obtain a white emulsion. The emulsion was heated to a system temperature of 75° C. and then reacted for 3 hours. Further, 30 parts of a 1% aqueous ammonium persulfate solution was mixed thereto, and the resulting mixture was matured at 65° C. for 12 hours to produce an aqueous dispersion liquid of a vinyl resin (a copolymer of methacrylic acid-butyl acrylate-a sodium salt of a sulfate ester of methacrylic acid ethylene oxide adduct), Fine Particle Dispersion Liquid 3.

The volume average particle diameter of the obtained Fine Particle Dispersion Liquid 3 measured by a particle size distribution measurement device (LA-920, manufactured by HORIBA, Ltd.) was 530 nm. Further, a part of Fine Particle Dispersion Liquid 3 was dried to isolate a resin content. The resin content had a glass transition temperature (Tg) of 59° C., and a mass average molecular mass of 120,000.

—Synthesis of Low-Molecular Polyester—

In a reaction vessel equipped with a cooling tube, a stirrer and a nitrogen inlet tube, 229 parts of a bisphenol A ethylene oxide (2 mol) adduct, 264 parts of a bisphenol A propylene oxide (3 mol) adduct, 208 parts of terephthalic acid, 80 parts of an adipic acid, and 2 parts of dibutyltin oxide were charged and reacted under atmospheric pressure at 230° C. for 9 hours. Subsequently, after having been reacted for 5 hours under reduced pressure of 10 mmHg to 15 mmHg, 35 parts of trimellitic anhydride was added to the resulting mixture in the reaction vessel, and reacted for 2 hours at 180° C. under atmospheric pressure to synthesize Low-Molecular Polyester 2.

The obtained Low-Molecular Polyester 2 had a number average molecular mass of 1,800, a mass average molecular mass of 3,500, a glass transition temperature (Tg) of 38° C., and an acid value of 25 mgKOH/g.

Example 4

Production of Toner 4

Toner 4 was produced in the same manner as in Example 1, except that the Low-Molecular Polyester in Example 1 was changed as follows:

—Synthesis of Low-Molecular Polyester—

In a reaction vessel equipped with a cooling tube, a stirrer and a nitrogen inlet tube, 229 parts of a bisphenol A ethylene oxide (2 mol) adduct, 264 parts of a bisphenol A propylene oxide (3 mol) adduct, 208 parts of terephthalic acid, 80 parts of an adipic acid, and 2 parts of dibutyltin oxide were charged and reacted under atmospheric pressure at 230° C. for 9 hours. Subsequently, after having been reacted for 5 hours under reduced pressure of 10 mmHg to 15 mmHg, 35 parts of trimellitic anhydride was added to the resulting mixture in the reaction vessel, and reacted for 2 hours at 180° C. under atmospheric pressure to synthesize Low-Molecular Polyester 3.

The obtained Low-Molecular Polyester 3 had a number average molecular mass of 1,800, a mass average molecular mass of 3,500, a glass transition temperature (Tg) of 38° C., and an acid value of 25 mgKOH/g.

Example 5

Production of Toner 5

Toner 5 was produced in the same manner as in Example 1, except that the Emulsification to desolvation in Example 1 was changed as follows:

—Emulsification to Desolvation—

In a vessel, 749 parts of the Pigment/Wax dispersion Liquid 1, 115 parts of Prepolymer 1 and 2.9 parts of Ketimine Compound 1 were loaded and mixed using a TK homomixer (manufactured by Tokushu Kika Kogyo Co., Ltd.) at 5,000 rpm for two minutes. Subsequently, 1,200 parts of Aqueous Phase 1 was added to the vessel and mixed using the TK homomixer at a rotational frequency of 13,000 rpm for 5 minutes to obtain Emulsified Slurry 1.

In a vessel equipped with a stirrer and a thermometer, Emulsified Slurry 1 was added for desolvation at 30° C. for 8 hours, and then aged at 40° C. for 24 hours to obtain Dispersed Slurry 1.

Comparative Example 1

Production of Toner 6

Toner 6 was produced in the same manner as in Example 1, except that the Organic Fine Particle Emulsion in Example 1 was changed as follows:

—Synthesis of Organic Fine Particle Emulsion—

Into a reaction vessel equipped with a stirring rod and a thermometer, 683 parts of water, 11 parts of a sodium salt of a sulfate ester of methacrylic acid ethylene oxide adduct (ELEMINOL RS-30, manufactured by Sanyo Chemical Industries Ltd.), 166 parts of methacrylic acid, 110 parts of butyl acrylate, and 1 part of ammonium persulfate were charged, and stirred at 3,800 rpm for 30 minutes to obtain a white emulsion. The emulsion was heated to a system temperature of 75° C. and then reacted for 4 hours. Further, 30 parts of a 1% aqueous ammonium persulfate solution was mixed thereto, and the resulting mixture was matured at 75° C. for 6 hours to produce an aqueous dispersion liquid of a vinyl resin (a copolymer of methacrylic acid-butyl acrylate-a sodium salt of a sulfate ester of methacrylic acid ethylene oxide adduct), Fine Particle Dispersion Liquid 4.

The volume average particle diameter of the obtained Fine Particle Dispersion Liquid 4 measured by a particle size distribution measurement device (LA-920, manufactured by HORIBA, Ltd.) was 110 nm. Further, a part of Fine Particle Dispersion Liquid 4 was dried to isolate a resin content. The resin content had a glass transition temperature (Tg) of 58° C., and a mass average molecular mass of 130,000.

Comparative Example 2

Production of Toner 7

Toner 7 was produced in the same manner as in Example 1, except that the Organic Fine Particle Emulsion in Example 1 was changed as follows:

—Synthesis of Organic Fine Particle Emulsion—

Into a reaction vessel equipped with a stirring rod and a thermometer, 683 parts of water, 11 parts of a sodium salt of a sulfate ester of methacrylic acid ethylene oxide adduct (ELEMINOL RS-30, manufactured by Sanyo Chemical Industries Ltd.), 166 parts of methacrylic acid, 70 parts of butyl acrylate, and 1 part of ammonium persulfate were charged, and stirred at 1,500 rpm for 20 minutes to obtain a white emulsion. The emulsion was heated to a system temperature of 75° C. and then reacted for 3 hours. Further, 30 parts of a 1% aqueous ammonium persulfate solution was mixed thereto, and the resulting mixture was matured at 65° C. for 12 hours to produce an aqueous dispersion liquid of a vinyl resin (a copolymer of methacrylic acid-butyl acrylate-a sodium salt of a sulfate ester of methacrylic acid ethylene oxide adduct), Fine Particle Dispersion Liquid 5.

The volume average particle diameter of the obtained Fine Particle Dispersion Liquid 5 measured by a particle size distribution measurement device (LA-920, manufactured by HORIBA, Ltd.) was 680 nm. Further, a part of Fine Particle Dispersion Liquid 5 was dried to isolate a resin content. The resin content had a glass transition temperature (Tg) of 58° C., and a mass average molecular mass of 130,000.

Comparative Example 3

Production of Toner 8

Toner 8 was produced in the same manner as in Example 1, except that the Low-Molecular Polyester in Example 1 was changed as follows:

—Synthesis of Low-Molecular Polyester—

In a reaction vessel equipped with a cooling tube, a stirrer and a nitrogen inlet tube, 229 parts of a bisphenol A ethylene oxide (2 mol) adduct, 529 parts of a bisphenol A propylene oxide (3 mol) adduct, 208 parts of terephthalic acid, 46 parts of an adipic acid, and 2 parts of dibutyltin oxide were charged and reacted under atmospheric pressure at 230° C. for 10 hours. Subsequently, after having been reacted for 8 hours under reduced pressure of 10 mmHg to 15 mmHg, 70 parts of trimellitic anhydride was added to the resulting mixture in the reaction vessel, and reacted for 3 hours at 180° C. under atmospheric pressure to synthesize Low-Molecular Polyester 4.

The obtained Low-Molecular Polyester 4 had a number average molecular mass of 2,800, a mass average molecular mass of 7,300, a glass transition temperature (Tg) of 47° C., and an acid value of 25 mgKOH/g.

Comparative Example 4

Production of Toner 9

Toner 9 was produced in the same manner as in Example 1, except that the Low-Molecular Polyester in Example 1 was changed as follows:

—Synthesis of Low-Molecular Polyester—

In a reaction vessel equipped with a cooling tube, a stirrer and a nitrogen inlet tube, 430 parts of a bisphenol A propylene oxide (2 mol) adduct, 300 parts of a bisphenol A propylene oxide (3 mol) adduct, 257 parts of terephthalic acid, 65 parts of an isophthalic acid, and 10 parts of maleic anhydride were charged and reacted for 5 hours at 150° C. while water generated under nitrogen stream was distilled away. Subsequently, after having been reacted under reduced pressure of 5 mmHg to 20 mmHg, the reactant was taken out when it had an acid value of 5 mgKOH/g. The reactant was cooled to room temperature, and then pulverized to obtain Low-Molecular Polyester 5.

The obtained Low-Molecular Polyester 5 had an acid value of 7 mgKOH/g, a glass transition temperature (Tg) of 45° C. and a mass average molecular mass of 3,600.

The physical properties of Toners 1 to 9 were measured as described below. The results are shown in Table 1.

<Measurement of Shell Thickness>

Approximately one spatula of each toner was embedded in an epoxy resin, and then the epoxy resin was cured to obtain a sample. The sample was exposed to ruthenium tetroxide for 5 minutes so as to dye a shell and a core for identification. The sample was cut out with a knife to reveal the cross section thereof and an ultra thin section having a thickness of 200 nm of the toner was prepared by an ultramicrotome (ULTRACUT UCT manufactured by Leica, with the use of a diamond knife). And then, the ultra thin section of the toner was observed by a transmission electron microscope (TEM), H7000 (manufactured by Hitachi High-Technologies Corporation) at an acceleration voltage of 100 kV. The shell thicknesses of 10 toner particles were randomly measured and the average value thereof was found.

<Measurement of Softening Temperature of Shell ST and Softening Temperature of Core CT>

The softening temperatures of a core and a shell were measured by a SPM probe with an integrated heater, specifically, by a device in which a thermomechanical analysis (TMA) unit for nano-thermal analysis is interfaced with SPM (referred to as a nano-TA system). As the scanning probe microscope, MMAFM MULTIMODE SPM unit (manufactured by Veeco Instruments) was used. The nano-TA is a technique of evaluating a softening property (TMA property) and heat properties of a sample by the SPM probe with an integrated heater. The probe, i.e. a cantilever was moved to a sample measurement position, a tip of the cantilever was raised in temperature, and the deflection value of the cantilever was obtained so as to obtain subduction corresponding to a tip temperature, thereby obtaining an inflection point on the deflection curve. The inflection point on the deflection curve was defined as a softening temperature for evaluation.

In the nano-TA system, softening property (TMA property) in a targeted position could be evaluated with a resolution of 20 nm by using a special acute cantilever equal to that used in an atomic force microscope. The alignment for measurement could be performed generally by a contact mode or tapping mode atomic force microscope. The softening properties of the shell and core of the toner in a cross section were respectively evaluated. In view of variation of the measurement results, an average softening temperature of 5 toner particles was evaluated. The temperature rise rate of the cantilever was 5° C./sec. The temperature applied to the probe by the device was controlled by the voltage applied to the probe. The actual temperature applied to the tip of the probe corresponding to the voltage was adjusted by calibrating with a standard curve obtained using 3 standard resins of which softening temperatures were known. However, actually the voltage and temperature did not provide a complete linear relationship. Therefore, the standard curve was approximated by a cubic curve.

<Average Circularity of Toner>

The average circularity of the toner could be measured by a flow particle image analyzer, FPIA-2100 manufactured by SYSMEX Corp. Specifically, 100 mL to 150 mL of pure water was poured into a vessel, 0.1 mL to 0.5 mL of a surfactant as a dispersant, alkylbenzene sulfonate, was added, and 0.1 g to 0.5 g of each toner was further added therein, and dispersed. Next, the obtained dispersion liquid was dispersed by an ultrasonic dispersion device (manufactured by HONDA ELECTRONICS) for 1 to 3 minutes to adjust the concentration into 3,000/μL to 10,000/μL. Then, the shape and the distribution of the toner were measure. From the measurement results, an average circularity was obtained.

<Shape Factor SF-1 and SF-2>

An FE-SEM image of a toner was taken by FE-SEM (S-4200) by Hitachi High-Technologies Corporation, and 300 FE-SEM images were randomly sampled and the image information thereof were introduced into an image analyzer, Luzex AP (manufactured by NIRECO CORPORATION) through an interface, and analyzed and calculated by the following equations. The obtained values were defined respectively as SF-1 and SF-2.

$$SF\text{-}1=(L2/A)\times(\pi/4)\times100$$

$$SF\text{-}2=(P2/A)\times(1/4\pi)\times100$$

<Measurement of Mass Average Particle Diameter and Particle Size Distribution>

The mass average particle diameter and particle size distribution of each toner was measured by Coulter Counter method using COULTER COUNTER TA-IL (manufactured by Beckman Coulter, Inc.).

Firstly, in 100 mL to 150 mL of an electrolytic aqueous solution, 0.1 mL to 5 mL of a surfactant (polyoxyethylene alkyl ether) as a dispersant was added. An electrolytic aqueous solution was a 1% NaCl aqueous solution using a primary sodium chloride, ISOTON-II (manufactured by Beckman Coulter, Inc.). After addition of the surfactant, 2 mg to 20 mg of a measurement sample was further added to the electrolytic aqueous solution. The electrolytic solution with the sample suspended therein was dispersed by an ultrasonic dispersion device for 1 minute to 3 minutes. The mass and the number of the toner were measured by the measurement device using an aperture having a diameter of 100 μm, and a mass distribution and a number distribution were calculated. From the obtained distributions, the mass average particle diameter $D_4$ and the number average particle diameter Dn of the toner could be determined.

For channels used in the measurement device, the following 13 channels were used, and particles having a particle diameter of 2.00 μm or more to less than 40.30 μm are intended to be measured: a channel of 2.00 μm or more to less than 2.52 μm; a channel of 2.52 μm or more to less than 3.17 μm; a channel of 3.17 μm or more to less than 4.00 μm; a channel of 4.00 μm or more to less than 5.04 μm; a channel of 5.04 μm or more to less than 6.35 μm; a channel of 6.35 μm or more to less than 8.00 μm; a channel of 8.00 μm or more to less than 10.08 μm; a channel of 10.08 μm or more to less than 12.70 μm; a channel of 12.70 μm or more to less than 16.00 μm; a channel of 16.00 μm or more to less than 20.20 μm; a channel of 20.20 μm or more to less than 25.40 μm; a channel of 25.40 μm or more to less than 32.00 μm and a channel of 32.00 μm or more to less than 40.30 μm.

TABLE 1

| | Shell thickness | | Average | Shape factor | | Particle size distribution | | |
|---|---|---|---|---|---|---|---|---|
| | (μm) | ST/CT | circularity | SF-1 | SF-2 | $D_4$ (μm) | Dn (μm) | $D_4$/Dn |
| Example 1 | 0.4 | 1.3 | 0.97 | 131 | 122 | 4.6 | 4.4 | 1.05 |
| Example 2 | 1.2 | 1.2 | 0.93 | 129 | 132 | 4.3 | 3.9 | 1.10 |
| Example 3 | 1.7 | 1.5 | 0.97 | 114 | 114 | 3.0 | 2.7 | 1.11 |
| Example 4 | 0.4 | 1.9 | 0.92 | 133 | 139 | 4.9 | 4.3 | 1.14 |
| Example 5 | 0.4 | 1.3 | 0.91 | 152 | 147 | 6.2 | 4.9 | 1.27 |
| Comparative Example 1 | Shell was not detected. | Shell was not detected. | 0.96 | 119 | 120 | 5.0 | 4.2 | 1.19 |
| Comparative Example 2 | 2.1 | 1.3 | 0.92 | 141 | 162 | 5.2 | 4.4 | 1.18 |
| Comparative Example 3 | 0.4 | 1.0 | 0.91 | 160 | 154 | 7.1 | 5.9 | 1.20 |
| Comparative Example 4 | 0.4 | 2.1 | 0.92 | 155 | 151 | 5.2 | 4.3 | 1.21 |

In Comparative Example 1 shell was not detected, because the organic fine particle emulsion had a small particle diameter, i.e. 110 nm. After the toner was produced using the organic fine particle emulsion, the toner did not have a shell which was thick enough to be detected.

Production of Two-Component Developer

A two-component developer was produced by uniformly mixing 7 parts of respective toners and 100 parts of a carrier which was a ferrite carrier having an average particle diameter of 35 μm coated with a silicone resin having 0.5 μm-thick in average, by using a TURBULA MIXER of the type which stirred contents therein by rolling of the container itself, so as to charge them.

| Production of Carrier | |
|---|---|
| Core Material | |
| Mn ferrite particles*1) | 5,000 parts |
| Coating Material | |
| toluene | 450 parts |
| silicone resin (SR2400)*2) | 450 parts |
| amino silane (SH6020)*3) | 10 parts |
| carbon black | 10 parts |

*1)mass average diameter: 35 μm
*2)non-volatile content: 50%, by Dow Corning Toray Silicone Co., Ltd.
*3)by Dow Corning Toray Silicone Co., Ltd.

The coating material was dispersed by a stirrer for 10 minutes to prepare a coating liquid, and the coating liquid and the core material were poured into a coating device configured to apply the coating liquid onto the core material while swirling them by use of a rotatable bottom disc and stirring blade provided in a fluidized bed, so as to apply the coating liquid onto the core material. The coated product was baked in an electric furnace at 250° C. for 2 hours to prepare a carrier.

<Image Evaluation>

As an evaluation device, IMAGIO NEO C600 (manufactured by Ricoh Company, Ltd.), in which a developing part and fixing part were converted, was used. The converted device was used under the conditions that a development gap was 1.26 mm, a doctor blade gap was 1.6 mm, and a reflection photo sensor was switched off, so that a linear velocity of a system became 1,700 mm/sec. The fixing unit of the fixing part had a fixed surface pressure of 39N/cm$^2$ and a fixing nip width of 10 mm. On the surface of the fixing member, a tetrafluoroethylene-perfluoroalkyl vinyl ether copolymer resin (PFA) was coated, molded, and then surface-adjusted to be used. The area of an image bearing member, a developing unit, and a transferring unit was controlled at the temperature of 30° C. to 45° C. The heating temperature of a fixing roller was 150° C.

—Measurement of Linear Velocity of System—

A linear velocity of a system was found in the following manner: An A4-size paper was fed in a longitudinal direction (the length of paper in the paper feeding direction was 297 mm) and 100 sheets thereof were continuously output by an image forming apparatus. When the output time from start to end was defined as A second, and a linear velocity of a system was defined as B, the linear velocity of a system was found by the following equation:

$$B(\text{mm/sec})=100\ \text{sheets}\times 297\ \text{mm}/A\ \text{second}$$

—Measurement of Fixed Surface Pressure—

A fixed surface pressure was measured by a pressure distribution measurement system, PINCH (manufactured by NITTA CORPORATION).

<Low-Temperature Fixability>

After output of 100,000 sheets of an image chart with a 5% image area using each of the obtained two-component developers and the evaluation device, images were output as the temperature of the fixing roller was changed by 5° C. and the fixability was measured. As a transfer paper, full color PPC paper type 6200 (manufactured by Ricoh Company, Ltd.) was used.

The fixing temperature of the fixing roller was changed so as to obtain a printed image having an image density of 1.2 measured by X-RITE 938. A copy image at each temperature was rubbed 10 times with a sand rubber eraser mounted on a clock meter, and an image density of the image before being rubbed off and that after being rubbed off were measured and found a fixation ratio by the following equation. The results are shown in Table 2.

Fixation ratio (%)=(image density after being rubbed off with a sand rubber eraser 10 times/image density before being rubbed off with the sand rubber eraser)×100

Then, a temperature at which the fixation ratio was 70% or more was defined as a lower limit of fixing temperature. The low-temperature fixability was evaluated on the basis of the following evaluation criteria.

Evaluation Criteria

A: The toner was started to fix at very low temperature, and the lower limit of fixing temperature of the toner was low. Most excellent low-temperature fixability B: Excellent low-temperature fixability C: Slightly inferior low-temperature fixability D: Inferior low-temperature fixability <Heat Resistant Storage Property>

10 g of each toner was measured and charged in a 20 ml glass vessel. The glass vessel was tapped 100 times with a tapping device, placed in a thermostatic bath at a high temperature and high humidity (55° C. and 80% RH) and left to stand for 48 hours. Subsequently, the penetration of the toner was measured by a penetrameter (manufactured by Nikka Engineering, under manual conditions) under the conditions of manual. On the other hand, the penetration of a toner stored in an environment of low temperature and low humidity (10° C. and 15% RH) was evaluated in the same manner. From the comparison between the penetration of the toner at the high temperature and high humidity and that at low temperature and low humidity, the smaller value was selected for evaluation on the basis of the following evaluation criteria. The results are shown in Table 2.

Evaluation Criteria

A: 20 mm or more

B: 15 mm or more to less than 20 mm

C: 10 mm or more to less than 15 mm

D: less than 10 mm

<Developing Stability>

The endurance test, in which 10,000 sheets of an image chart with a 5% image area were continuously output using each of the obtained two-component developers and the evaluation device, was performed. 1 g of the developer was weighed, and then the change of the charge amount was obtained by a blow off method. The endurance test, in which 10,000 sheets of an image chart with a 50% image area were continuously output was performed. 1 g of the developer was weighed, and then the change of the charge amount was obtained by a blow off method. From the comparison between the endurance tests, the larger value in the change of the charge amount was selected for evaluation on the basis of the following evaluation criteria. The results are shown in Table 2.

—Blow off Method—

In a cylindrical Faraday cage in which a wire mesh was provided at both ends, the developer was loaded, and then the toner was separated from the developer by high-pressure air. The residual charge amount was measured by an electrometer. The mass of the toner in the developer was found from the difference between the mass of the Faraday cage before performing the blow off method and that after performing the blow off method.

Evaluation Criteria

A: Change of the charge amount was 5 μC/g or less

B: Change of the charge amount was more than 5 μC/g to 10 μC/g or less

C: Change of the charge amount was more than 10 μC/g

TABLE 2

| | Low temperature fixability | Heat resistant storage property | Developing stability |
|---|---|---|---|
| Example 1 | B | B | A |
| Example 2 | B | A | A |
| Example 3 | A | A | A |
| Example 4 | A | C | B |
| Example 5 | C | C | B |
| Comparative Example 1 | D | D | C |
| Comparative Example 2 | D | B | A |
| Comparative Example 3 | D | D | A |
| Comparative Example 4 | D | D | C |

The toner of the present invention has a suitable low temperature fixability, heat resistant storage property, developing stability, and responsiveness to high speed printing, and is preferably used in high quality image formation. The developer and image forming method of the present invention using the toner of the present invention are preferably used in high quality image formation by electrophotography.

What is claimed is:

1. A toner comprising:

a binder resin; and a colorant, wherein the toner has a core-shell structure composed of a core, and a shell having a thickness of 0.01 μm to 2 μm on a surface of the core, wherein the shell comprises fine resin particles, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

2. The toner according to claim 1, wherein the fine resin particles have a volume average particle diameter of 120 nm to 670 nm.

3. The toner according to claim 1, wherein the binder resin comprises a polyester.

4. The toner according to claim 1, wherein the toner comprises a modified polyester.

5. The toner according to claim 1, wherein the toner is formed by dispersing in an aqueous medium containing the fine resin particles an oil droplet of an organic solvent in which a toner composition comprising at least a prepolymer is dissolved, and subjecting to at least one of cross-linking reaction and elongation reaction.

6. The toner according to claim 1, wherein the toner is formed by subjecting a toner composition which comprises at least a polymer having a site reactive with a compound having an active hydrogen group, a polyester, a colorant and a releasing agent to at least one of cross-linking reaction and elongation reaction in an aqueous medium in the presence of the fine resin particles.

7. The toner according to claim 1, wherein the toner has an average circularity of 0.93 to 0.99.

8. The toner according to claim 1, wherein the toner has a shape factor SF-1 of 100 to 150, and a shape factor SF-2 of 100 to 140.

9. The toner according to claim 1, wherein the toner has a mass average particle diameter $D_4$ of 2 μm to 7 μm, and a ratio $D_4/Dn$ of 1.25 or less, where $D_4$ is the mass average particle diameter and Dn is a number average particle diameter.

10. A developer comprising:

a toner; and a carrier, wherein the toner comprises:

a binder resin; and a colorant, wherein the toner has a core-shell structure composed of a core, and a shell having a thickness of 0.01 μm to 2 μm on a surface of the core, wherein the shell comprises fine resin particles, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

11. The developer according to claim 10, wherein the fine resin particles have a volume average particle diameter of 120 nm to 670 nm.

12. An image forming method comprising:

forming a latent electrostatic image on a latent electrostatic image bearing member;

developing the latent electrostatic image using a toner so as to form a visible image;

transferring the visible image onto a recording medium; and fixing a transferred image onto the recording medium by a fixing unit, wherein the toner comprises:

a binder resin; and a colorant, wherein the toner has a core-shell structure composed of a core, and a shell having a thickness of 0.01 μm to 2 μm on a surface of the core, wherein the shell comprises fine resin particles, and wherein the toner satisfies the following relation:

$$1.1 \leq ST/CT \leq 2.0$$

where ST is a softening temperature of the shell, and CT is a softening temperature of the core, both measured by a SPM probe with an integrated heater.

13. The image forming method according to claim 12, wherein the fine resin particles have a volume average particle diameter of 120 nm to 670 nm.

* * * * *